US010280647B2

(12) United States Patent
Hollman

(10) Patent No.: US 10,280,647 B2
(45) Date of Patent: May 7, 2019

(54) COMBINATION LOCK

(71) Applicant: KEYLESS.CO LLC, Irving, TX (US)

(72) Inventor: Joe Hollman, Irving, TX (US)

(73) Assignee: KEYLESS.CO LLC, Irving, TX (US)

( * ) Notice: Subject to any disclaimer, the term of this patent is extended or adjusted under 35 U.S.C. 154(b) by 121 days.

(21) Appl. No.: 15/635,157

(22) Filed: Jun. 27, 2017

(65) Prior Publication Data

US 2018/0002952 A1 Jan. 4, 2018

Related U.S. Application Data

(60) Provisional application No. 62/355,524, filed on Jun. 28, 2016.

(51) Int. Cl.

| | |
|---|---|
| ***E05B 37/00*** | (2006.01) |
| ***E05B 37/02*** | (2006.01) |
| ***E05B 27/00*** | (2006.01) |
| ***E05B 35/08*** | (2006.01) |
| ***E05B 35/10*** | (2006.01) |
| ***E05B 65/02*** | (2006.01) |

(52) U.S. Cl.

CPC ..... *E05B 37/0034* (2013.01); *E05B 27/005* (2013.01); *E05B 35/083* (2013.01); *E05B 35/10* (2013.01); *E05B 37/0041* (2013.01); *E05B 37/0048* (2013.01); *E05B 37/0096* (2013.01); *E05B 37/02* (2013.01); *E05B 65/025* (2013.01); *E05B 37/0072* (2013.01)

(58) Field of Classification Search

None

See application file for complete search history.

(56) References Cited

U.S. PATENT DOCUMENTS

| | | | | | |
|---|---|---|---|---|---|
| 1,391,357 | A * | 9/1921 | Baer | E05B 37/00 | 292/341.15 |
| 3,611,761 | A * | 10/1971 | Atkinson | E05B 37/0096 | 70/129 |
| 4,104,896 | A * | 8/1978 | Hahn | E05B 37/02 | 70/310 |
| 4,683,738 | A * | 8/1987 | Berkowitz | E05B 37/00 | 70/21 |
| 4,881,390 | A * | 11/1989 | Vale | E05B 37/02 | 70/219 |
| 4,895,036 | A * | 1/1990 | Larson | E05B 21/066 | 70/284 |
| 6,122,945 | A * | 9/2000 | Grant | E05B 17/145 | 292/DIG. 2 |

(Continued)

*Primary Examiner* — Christopher J Boswell

(74) *Attorney, Agent, or Firm* — Joseph G. Chu; JCIP

(57) ABSTRACT

A programmable combination lock with keyed lock override is disclosed. The lock employs a stack of rings and dial wheels, with a mechanism for coupling and decoupling the rings and dial wheels. A user can program a custom code by unlocking the combination and rotating the inner and outer dial wheels until the desired code is indicated, and then locking the combination lock to set the code. A keyed lock with a master key couples to the combination lock and can override a combination lock in the locked state. The keyed lock allows multiple keys to lock and unlock the combination lock. In the event that a user loses the master key, the user can use the second key to create a new lock combination to operate the lock, yet render the lost master key inoperable.

20 Claims, 21 Drawing Sheets

(56) References Cited

U.S. PATENT DOCUMENTS

| | | | | |
|---|---|---|---|---|
| 7,266,981 | B2 * | 9/2007 | Flory | E05B 37/0034 70/284 |
| 7,383,708 | B2 * | 6/2008 | Liu | E05B 37/00 70/301 |
| 7,975,517 | B2 * | 7/2011 | Liu | E05B 37/08 70/292 |
| 8,047,032 | B1 * | 11/2011 | Liu | E05B 37/0096 70/303 A |
| 8,359,890 | B2 * | 1/2013 | Kitchen | E05B 49/008 70/278.5 |

* cited by examiner

COMBINATION LOCK

RELATED APPLICATION INFORMATION

The present application claims priority under 35 U.S.C. Section 119(e) to U.S. Provisional Patent Application Ser. No. 62/355,524 filed Jun. 28, 2016 entitled "COMBINATION LOCK" the disclosure of which is incorporated herein by reference in its entirety.

BACKGROUND OF THE INVENTION

1. Field of the Invention

This invention generally relates to a device and a method of providing a combination lock that comprises multiple combination dials and multiple keys to be used with a single lock system.

2. Description of the Related Art

The combination locks known in the art typically use a single combination dial, which is commonly seen in padlocks and safes. In a single combination dial lock, the combination dial typically consists of a set of numbers etched on its radial surface. Upon turning the dial clockwise and counterclockwise to specific numbers, a spindle attached to the dial turns a drive cam and a wheel pack inside the lock to disengage a lock pin and unlock the lock system.

Some applications, such as locks for gym lockers, may require multiple users to share the same locker. However, security may be compromised as multiple users have access to the same locker.

Hence, there is a need to improve conventional combination locks to enable multiple users to share the same lock without compromising security.

SUMMARY OF THE INVENTION

In the first aspect, a programmable combination lock assembly is disclosed. The programmable combination lock assembly comprises a base plate, a spring positioned above the base plate, and a stack of rotatable rings including a first ring and a second ring, each of the first and second rings having a notch formed in the interior circumference and a series of protrusions formed around the outer perimeter, the first ring positioned immediately above the spring, the second ring positioned immediately above the first ring, wherein the spring is urging the stack of rotatable rings away from the base plate.

The programmable combination lock assembly further comprises a stack of dial wheels including a first dial wheel and a second dial wheel, each of the first and second dial wheels having an interior wall having a series of concave indentations configured to receive and release the protrusions of the rotatable rings, the first dial wheel configured to receive the first ring, the second dial wheel configured to receive the second ring, and a compression assembly for compressing and releasing the first and second rings, the compression assembly positioning the first and second rings so that the first and second rings may be received or released by the first and second dial wheels respectively.

The programmable combination lock assembly further comprises an ring engagement assembly having spring-loaded pins extending radially outward from a center axis toward the interior aperture of the rotatable rings, the ring engagement assembly unlocking the lock when the pins are aligned with the notches of the rotatable rings, the ring engagement assembly securing the rings when the pins align with the notches of the rotatable rings, a locking assembly coupled to the ring engagement assembly, the locking assembly rotatable from a locked position to an unlocked position, and a keyed lock coupled to the ring engagement assembly configured to selectively unlock the combination lock.

In a first preferred embodiment, the compression assembly comprises a two piece disk assembly comprising an outer disk having an aperture and an inner disk sized to be received within the outer disk, the inner disk having three teeth protruding away from the inner disk, each of the three teeth having a slopped surface and a nearly vertical surface, the outer disk having a channel formed in the inner circumference, the channel flat in one region and having three indentations, the channel shaped to receive the inner disk. The locking assembly preferably comprises a generally circular locking disk centered and movably coupled to the center axis of the base plate, the locking disk having a flat edge at the perimeter of the locking disk and a protruding arm emerging way from the center axis, the protruding arm positioned opposite the flat edge.

The keyed lock can preferably override the combination lock in a locked position by receiving a key into the keyed lock, allowing the combination lock to set to an unlocked state, and allowing dialing of the dial wheels until the dial wheels are secured in place. The code indicated when all of the dial wheels are secured indicates the last combination code used. The programmable combination lock assembly preferably further comprises a tensioning assembly comprising a curved arm, a tensioning spring, and a vertical wall, the curved arm pivotally connected to the base plate, the vertical wall extending radially outward from the base plate, the tensioning spring positioned between the curved arm and the vertical wall urging the curved arm to pivot away radially from the center axis and engage with the interior of the rotatable rings.

The keyed lock is reprogrammable having multiple keys such that if a master key is lost, a secondary key can be used to open the combination lock and render the master key inoperable. The keyed lock is reprogrammable using a reset key, such that the use of a reset key reactivates the master key. The keyed lock is coupled with the inner disk of the compression assembly, the inner disk rotating with the keyed lock and vertically urging the rotatable rings to disengage from the dial wheels.

In a second aspect, a programmable combination lock assembly is disclosed. The programmable combination lock assembly comprises a base plate, a spring positioned above the base plate, a stack of rotatable rings having a notch formed in the interior circumference and a series of protrusions formed around the outer perimeter, the rings positioned above the spring, wherein the spring is urging the stack of rotatable rings away from the base plate, and a stack of dial wheels having an interior wall having a series of concave indentations configured to receive and release the protrusions of the rotatable rings, each dial wheel placed immediately above the associated rotatable ring.

The programmable combination lock assembly further comprises a compression assembly for compressing and releasing the rotatable rings, the compression assembly positioning the rotatable rings so that the rings may be received or released by the dial wheels, and an ring engagement assembly having spring-loaded pins extending radially toward the interior aperture of the rotatable rings, the ring engagement assembly unlocking the lock when the pins are aligned with the notches of the rotatable rings, the ring engagement assembly securing the rings when the pins align with the notches of the rotatable rings.

The programmable combination lock assembly further comprises a locking assembly coupled to the ring engagement assembly, the locking assembly rotatable from a locked position to an unlocked position, and, a keyed lock coupled to the ring engagement assembly configured to selectively unlock the combination lock.

In a second preferred embodiment, the compression assembly comprises a two piece disk assembly comprising an outer disk having an aperture and an inner disk sized to be received within the outer disk, the inner disk having three teeth protruding away from the inner disk, each of the three teeth having a slopped surface and a nearly vertical surface, the outer disk having a channel formed in the inner circumference, the channel flat in one region and having three indentations, the channel shaped to receive the inner disk.

The locking assembly preferably comprises a generally circular locking disk centered and movably coupled to the center axis of the base plate, the locking disk having a flat edge at the perimeter of the locking disk and a protruding arm emerging way from the center axis, the protruding arm positioned opposite the flat edge.

The keyed lock can preferably override the combination lock in a locked position by receiving a key into the keyed lock, allowing the combination lock to set to an unlocked state, and allowing dialing of the dial wheels until the dial wheels are secured in place. The code indicated when all of the dial wheels are secured indicates the last combination code used.

The programmable combination lock assembly preferably further comprises a tensioning assembly comprising a curved arm, a tensioning spring, and a vertical wall, the curved arm pivotally connected to the base plate, the vertical wall extending radially outward from the base plate, the tensioning spring positioned between the curved arm and the vertical wall urging the curved arm to pivot away radially from the center axis and engage with the interior of the rotatable rings.

The keyed lock is preferably reprogrammable having multiple keys such that if a master key is lost, a secondary key can be used to open the combination lock and render the master key inoperable. The keyed lock is reprogrammable using a reset key, such that the use of a reset key reactivates the master key. The keyed lock is preferably coupled with the inner disk of the compression assembly, the inner disk rotating with the keyed lock and vertically urging the rotatable rings to disengage from the dial wheels.

In a third aspect, a programmable combination lock assembly is disclosed. The programmable combination lock assembly comprises a base plate having a circular well formed by a raised shoulder near the perimeter of the base plate, the center of the circular well defining a center axis which extends away from the base plate perpendicular, a spring positioned within the well of the base plate, the spring formed as a flat wire compression spring, and a stack of rotatable rings including a first ring and a second ring, each of the first and second rings having a notch formed in the interior circumference and a series of protrusions formed around the outer perimeter, the first ring positioned immediately above the spring, the second ring positioned immediately above the first ring, wherein the spring is urging the stack of rotatable rings away from the base plate.

The programmable combination lock assembly further comprises a stack of dial wheels including a first dial wheel and a second dial wheel, each of the first and second dial wheels having an interior wall having a series of concave indentations configured to receive and release the protrusions of the rotatable rings, the first dial wheel configured to receive the first ring, the second dial wheel configured to receive the second ring, and a compression assembly for compressing and releasing the first and second rings, the compression assembly positioning the first and second rings so that the first and second rings may be received or released by the first and second dial wheels respectively, the compression assembly comprises a two piece disk assembly comprising an outer disk having an aperture and an inner disk sized to be received within the outer disk, the inner disk having three teeth protruding away from the inner disk, each of the three teeth having a slopped surface and a nearly vertical surface, the outer disk having a channel formed in the inner circumference, the channel flat in one region and having three indentations, the channel shaped to receive the inner disk.

The programmable combination lock assembly further comprises an ring engagement assembly having spring-loaded pins extending radially outward from a center axis toward the interior aperture of the rotatable rings, the ring engagement assembly unlocking the lock when the pins are aligned with the notches of the rotatable rings, the ring engagement assembly securing the rings when the pins align with the notches of the rotatable rings, a locking assembly coupled to the ring engagement assembly, the locking assembly rotatable from a locked position to an unlocked position, and a keyed lock coupled to the ring engagement assembly configured to selectively unlock the combination lock.

In a third preferred embodiment, the keyed lock can override the combination lock in a locked position by receiving a key into the keyed lock, turning the combination lock to an unlocked state, and dialing the first and second dial wheels until the first and second dial wheels are secured in place.

The present invention has other objects and features of advantage which will be more readily apparent from the following description of the preferred embodiments of carrying out the invention, when taken in conjunction with the accompanying drawings.

DETAILED DESCRIPTION OF THE PREFERRED EMBODIMENTS

Figure 1:
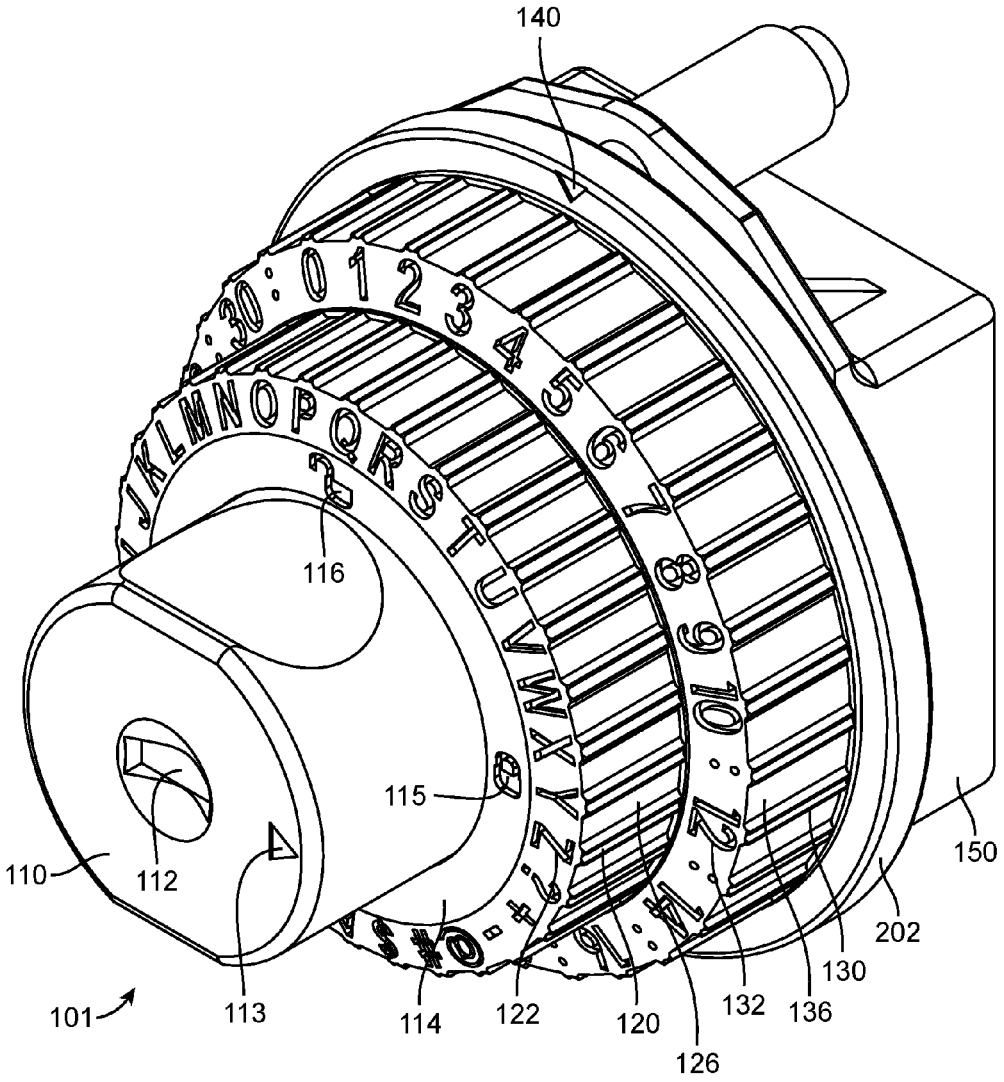
FIG. 1 is a front, perspective view of a reprogrammable combination lock having a keyed lock in one or more embodiments.

A current lock with embodiments described herein provides a combination lock that uses multiple combination dials and a set of multiple keys to work with a single cylinder lock to create multiple lock combinations. Embodiments described herein provide multiple combination dials in a single lock that would provide multiple combinations of numbers to make it difficult for an unauthorized person to try to unlock the lock system.

Further, the embodiments of the current lock described herein provide a lock system that allows a set of multiple keys to work with a single cylinder lock to create multiple lock combinations. In the event that a user loses one of the keys, the user can use any one of the remaining keys provided in the set to create a new lock combination to operate the lock, yet render the lost key inoperable to operate the same lock. This eliminates the need to replace an entire lock system from a door when a key is lost, yet maintains the maximum security of the lock in the event that an unauthorized person finds the lost key and attempts to use the lost key on the lock.

A preferred embodiment of a combination lock, or simply a lock, is illustrated in the figures and drawings enclosed herewith. The lock may be used on doors, cabinets, drawers, closets, safety boxes and the like. An exterior view of the lock in its fully assembled form is illustrated as comprising a keyway cylinder, a lock and unlock indicator, a first combination dial, a second combination dial, a cylinder core assembly and a pin lock housing.

The keyway cylinder forms the outermost protruding portion of the lock that comprises a keyway hole, a keyway surface, a keyway body and a keyway rim. The keyway body comprises identical indentations on opposite ends to allow a person to hold the keyway cylinder using his or her fingers and turn the keyway cylinder either clockwise or counterclockwise. A keyway arrow marker is provided on the keyway surface. The lock and unlock indicator is preferably circular, comprising a "lock" marking to indicate that the system is in a locked position and an "unlock" marking to indicate that the system is in an unlocked position. In the fully assembled form, the keyway cylinder is placed through the lock and unlock indicator, wherein the keyway rim is flush with the lock and unlock indicator. As mentioned above, the keyway cylinder is rotatable, and in the "locked" position, the keyway arrow marker is aligned with the "lock" marking on the lock and unlock indicator, and in the "unlocked" position, the keyway arrow marker is aligned with the "unlock" marking on the lock and unlock indicator. In the preferred embodiment, the keyway cylinder houses a portion of a cylinder core described in further detail below.

According to one embodiment, the first combination dial may comprise a circular structure with ridges on its circumferential portion, and markings of alphabetical letters and/or special symbols on its radial portion. The first combination dial is rotatable clockwise and counterclockwise.

According to one embodiment, the second combination dial may comprise a circular structure with a larger diameter than the first combination dial, with ridges on its circumferential portion, and markings of numbers on its radial portion. The second combination dial is also rotatable clockwise and counterclockwise.

In the fully assembled form, the first combination dial is flush with the lock and unlock indicator on one side, and flush with the second combination dial on the other side. Thus, fully assembled, the keyway cylinder, the lock and unlock indicator, the first combination dial and the second combination dial are stacked through each other. In yet another embodiment, the assembly may further comprise an inner washer ring and an outer clamping ring.

The cylinder core assembly generally comprises the cylinder core and a cylinder core housing. The cylinder core comprises a cylinder keyhole, a cylinder core body, a rear cylinder core top and a rear cylinder core bottom. The cylinder core housing generally houses at least a portion of the cylinder core and a portion of a spindle. The cylinder core and the spindle are connected to each other. The spindle comprises a head bolt and a torque, wherein the head bolt further comprises an upper recess and a lower recess that fit the rear cylinder core top and the rear cylinder core bottom. The torque is connected to a pin lock that is housed inside the pin lock housing. According to a preferred embodiment, the pin lock housing may have square shape. During operation, as the cylinder core turns clockwise and counterclockwise, the spindle in turn rotates and releases the pin lock in and out of the pin lock housing to lock and unlock a door. The pin lock housing further comprises mounting holes to mount the lock to the door.

According to the preferred embodiment, the lock also allows a set of multiple keys to be used with the cylinder core to create multiple lock combinations. In one embodiment of the invention, the cylinder core can be used with at least two different keys. In yet another embodiment of the invention, the cylinder core can be used with at least three keys. Each key comprises a bow, a blade, a set of cuts and a tip. Additionally, a reset key comprising a reset key bow, a reset key pin blade and a reset key tip may also be used. The reset key is used in a situation where the user forgets the combination codes to lock and unlock the device, wherein the key is inserted into the lock and the combination dials are rotated at the same time. When the combination dials stop turning, the combination codes are reset.

Having described the various components of the embodiments of the lock, the principles of operation of the lock can be further understood as follows. A user of the lock has the option of using the multiple combination dials or the set of multiple keys to operate the lock. If multiple combination dials are used, the user may first create a first combination of letters and/or special symbols to be used with the first combination dial and a second combination of numbers to be used with the second combination dial. To unlock the system, the user turns the first combination dial clockwise and counterclockwise to specific letters and/or symbols according to the predetermined first combination of letters and special symbols, followed by turning the second combination dial clockwise and counterclockwise according to the predetermined combination of numbers. If the correct combinations of letters, symbols and numbers are used with the first combination dial and the second combination dial, the keyway body is rotatable by hand, which in turn allows the cylinder core to rotate and release the pin lock to unlock the door.

In an aspect, a combination lock is disclosed. The combination lock comprises a keyway cylinder, a first combination dial, a second combination dial, a cylinder core assembly, and a pin lock housing. In a preferred embodiment, the first combination dial further comprises markings of letters and special symbols on its radial surface. The second combination dial preferably further comprises markings of numbers on its radial surface. The cylinder core assembly preferably further comprises a cylinder core, a cylinder core housing and a spindle. The combination lock preferably further comprises a set of multiple different keys. The combination lock preferably further comprises a reset key to reset combination codes to the combination lock.

Teachings relating to the keyed lock disclosed in application Ser. No. 14/598,915 filed Jan. 16, 2015 entitled "REPROGRAMMABLE CYLINDER LOCK" which issued as U.S. Pat. No. 9,512,642 on Dec. 6, 2016 may be employed herein and the disclosure of which is incorporated herein by reference in its entirety.

FIG. 1 is a front, perspective view of a reprogrammable combination lock 101 having a keyed lock in one or more embodiments. The combination lock 101 comprises a center knob 110, a lock status indicator ring 114, an inner dial wheel 120 (i.e., the second dial wheel), an outer dial wheel 130 (i.e., the first dial wheel), an inner locking mechanism 202, and a latching mechanism 150.

The center knob 110 has a keyhole 112 for access to a keyed lock as well as indicia of an arrow 113. The center knob 110 can be manually rotated one-quarter of a turn setting the combination lock 101 to a "locked" position or an "unlocked" position. The lock status indicator ring 114 has indicia of a "locked" state 115 and indicia of an "unlocked" state 116. When the indicia of an arrow 113 on the center knob 110 aligns with the indicia of a "locked" state, the lock is in a "locked" position. When the indicia of an arrow 113 on the center knob 110 aligned with the indicia of an "unlocked" state, the lock is in an "unlocked" position.

The inner dial wheel 120 has indicia of letters and symbols 122 and has a knurled outer surface 126. The outer dial wheel 130 has indicia of numbers 132 and has a knurled outer surface 136. The latching mechanism 150 is coupled to the inner locking mechanism 202 via a shaft (not shown) translates the rotational motion of the shaft to linear motion of a latch to provide a means of engaging and locking a door, gym locker, or cabinet for example. A second indicia of an arrow 140 is positioned behind the outer dial wheel 130.

Figure 2:
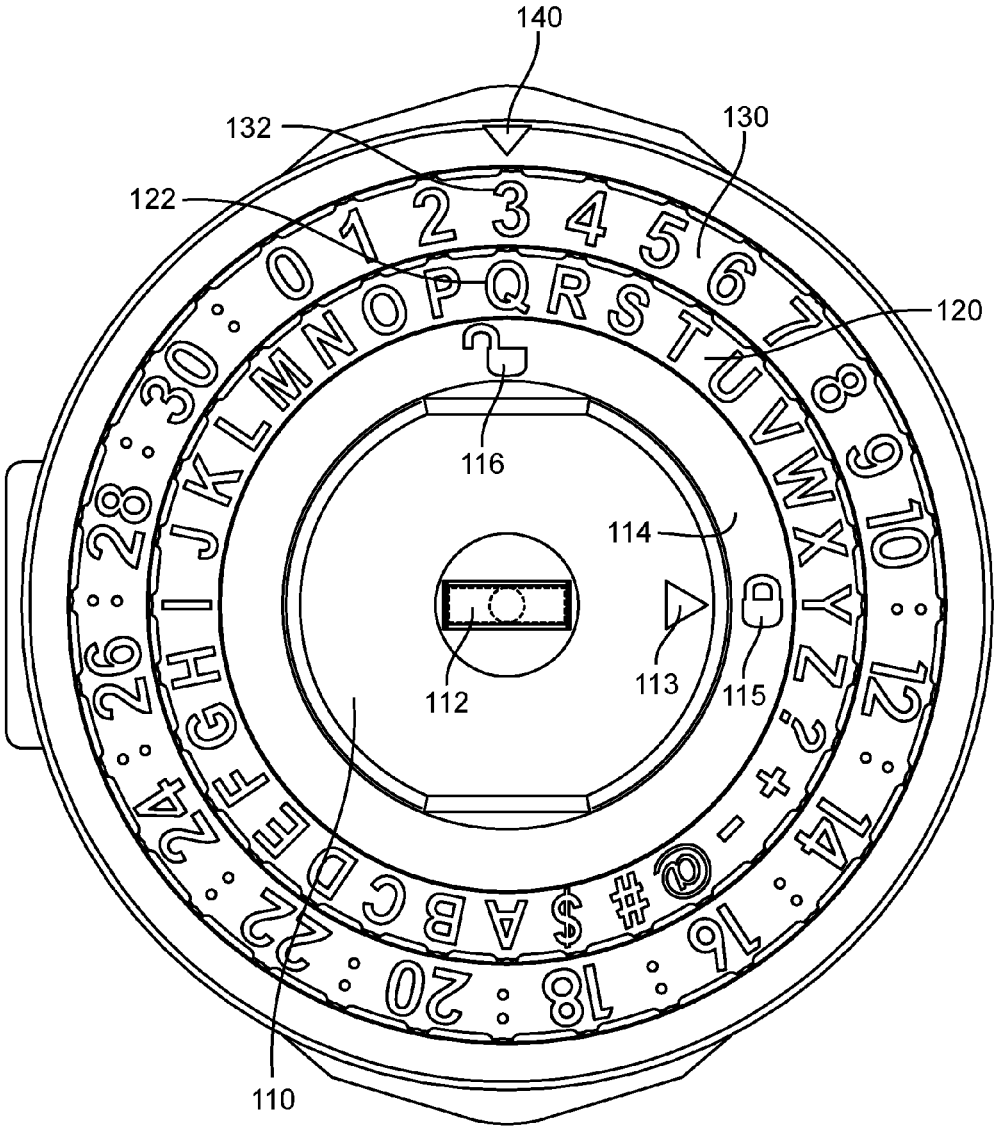
FIG. 2 is a front view of the reprogrammable combination lock.

FIG. 2 is a front view of the reprogrammable combination lock 101. The combination lock 101 may be programmed for each user to create a two character user code. For example, the outer and inner dial wheels 120 and 130 may be separately rotated by the user to select a code. This code will be indicated by the indicia of numbers 132 on the outer dial wheel 130 and by the indicia of letters and symbols 122 appearing directly below the indicia of an arrow 140. As shown in FIG. 2, if the user selected a code of "3Q," the user would rotate the inner and outer dial wheels 120 and 130 so the both the "3" and the letter "Q" are directly below the indicia of an arrow 140. The user can then turn the center knob 110 a quarter-turn counterclockwise so that the indicia of an arrow 113 on the center knob 110 point to the indicia of an "unlocked" state 116, hence unlocking the lock 101.

A user can program a custom code by performing the following actions. First the user would close the door to which the combination lock 101 is attached. Second, the user should make sure that the indicia of the arrow 113 on the center knob 110 is pointing up to 12 O'clock position. Third, the user then sets a custom code by rotating the inner and outer dial wheels 120 and 130 until the desired code is directly below the second indicia of an arrow 140. Fourth, the user then turns the center knob 110 one quarter turn clockwise so the lock 101 is in a locked position. Fifth, the user then should randomly rotate the inner and outer dial wheel 120 and 130 to scramble the code.

To unlock the combination lock 101, the user re-enters the combination code by turning dial wheels 120 and 130. The user the turns the center knob 110 back to the unlocked position. The user can then open the door and then scrambles the code for the next user.

Should the combination code become lost or unavailable, the combination lock 101 provides for lock out assistance. First, the manager key (e.g., key 293 in FIG. 5) is inserted into keyhole slot 112 and the user turns the center knob 110 a quarter-turn counterclockwise from a "locked" position to an "unlocked" position. The user then spins each dial wheel 120 and 130 until the dial wheels stop and are secured. When both dial wheels 120 and 130 are stopped, the last used combination code will be displayed. The user then turns the center knob 110 back to the locked position and removes the master key. The user then turns the center knob 110 back to the unlocked position, and scrambles the code for the next user.

The combination lock 101 allows a user to recalibrate the combination lock 101 to a new manager key making the compromised key no longer functional. This feature provides a fast and simple solution to a potential security threat without the need to replace the locks. The user uses a new key and makes sure that the lock 101 is in a locked position and the center knob 110 cannot be turned. The user then firmly inserts the new key into the keyhole slot 112. The user then turns the center knob 110 back to the "unlocked" position, and then turns the center knob 110 back to the "locked" position and removes the new key. This operation cancels out the current manager key and the new key becomes the only operational manager key. If the new key becomes compromised, this process may be repeated with another replacement key.

Figure 3:
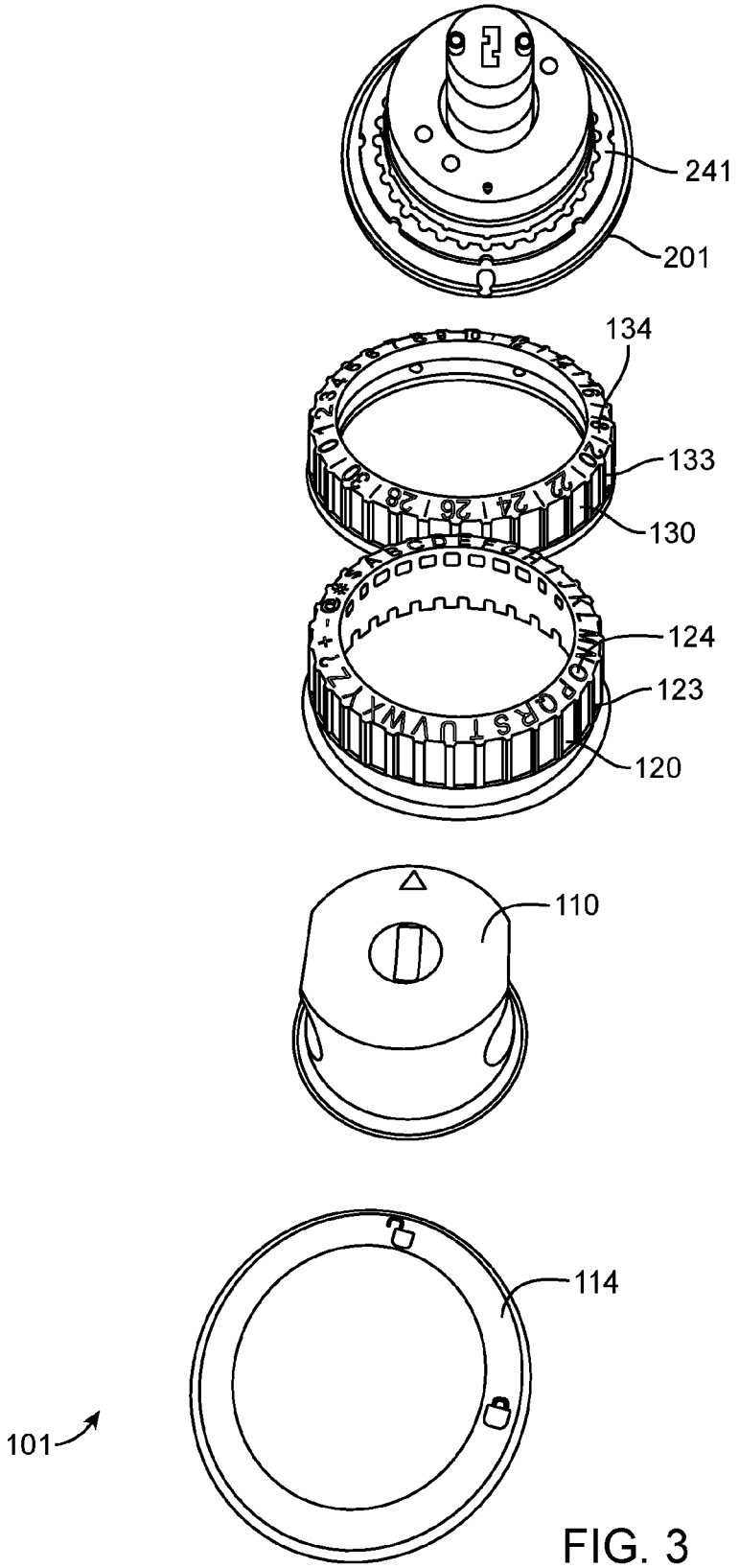
FIG. 3 is a top, perspective view of the components of the reprogrammable combination lock.

FIG. 3 is a top, perspective view of the components of the reprogrammable combination lock 101. The combination lock 101 comprises a center knob 110, a lock status indicator ring 114, an inner dial wheel 120, an outer dial wheel 130, and inner locking mechanism 202 showing a ring coupler 241 which may be used to couple with the outer ring 240 discussed below. The inner dial wheel 120 has a vertical cylindrical wall 123 and a flange 124 which extends from the vertical wall 123 toward the center of the inner dial wheel 120. Likewise, the outer dial wheel 130 has a vertical cylindrical wall 133 and a flange 134 which extends from the vertical wall 133 toward the center of the inner dial wheel 130.

Figure 4:
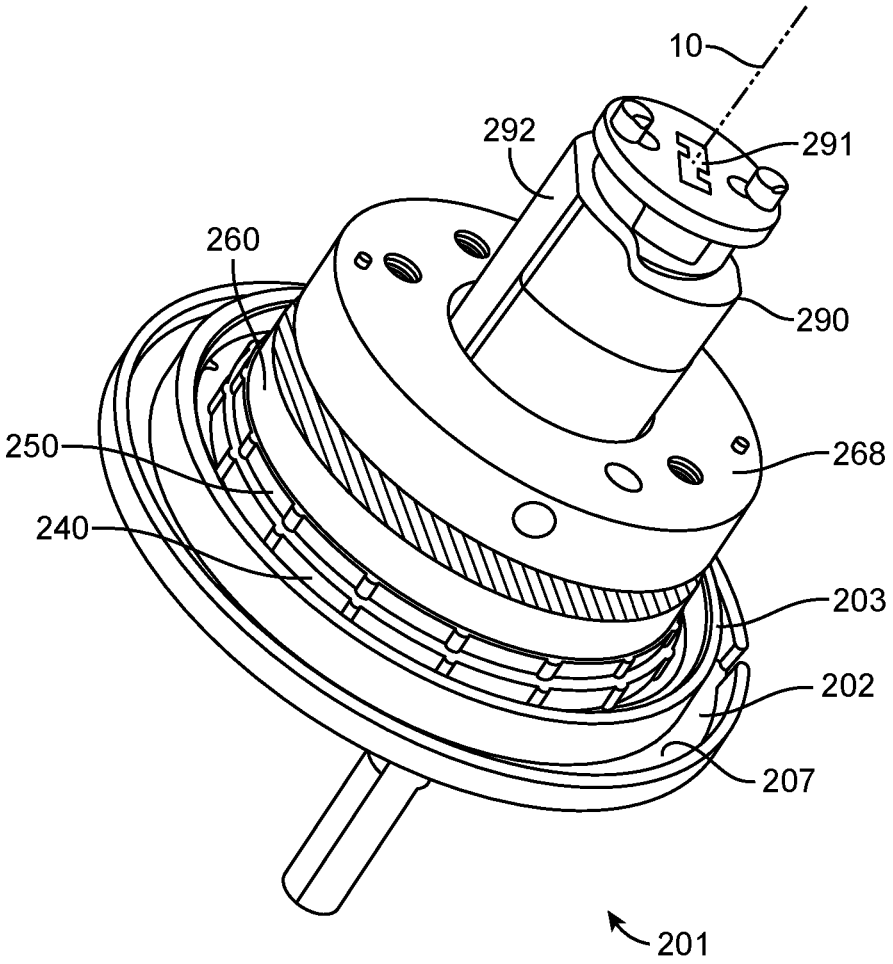
FIG. 4 is a top, perspective view of the inner locking mechanism of the combination lock.

FIG. 4 is a top, perspective view of the inner locking mechanism 201 of the combination lock 101. The inner locking mechanism 201 has a base plate 202, a stack of rotatable rings including an outer ring 240 (i.e., the first ring), and inner ring 250 (i.e., the second ring), a non-rotatable third ring 260, a top plate compression assembly 268, and a keyed lock 290.

The base plate 202 has a raised rim 203 projecting away from the base plate 202 to form a well 207. The rings 240 and 250 are "rotatable," meaning that in at least one configuration of the combination lock 101, the rings 240 and 250 may be rotated about the center axis 10 with some slack vertically along the center axis 10. The top plate compression assembly 268 is configured to selectively apply downward force on the rings 240, 250, and 260 when the combination lock 101 is placed in an unlocked position. The compression assembly 260 functions to selectively engage and disengage the outer ring 240 to the outer dial wheel 130, and the inner ring 250 to the inner dial wheel 120.

The keyed lock 290 has a keyhole slot 291 for receiving keys, and has a flat surface 292 which couples the keyed lock 290 to the compression assembly 260 as discussed below.

Figure 5:
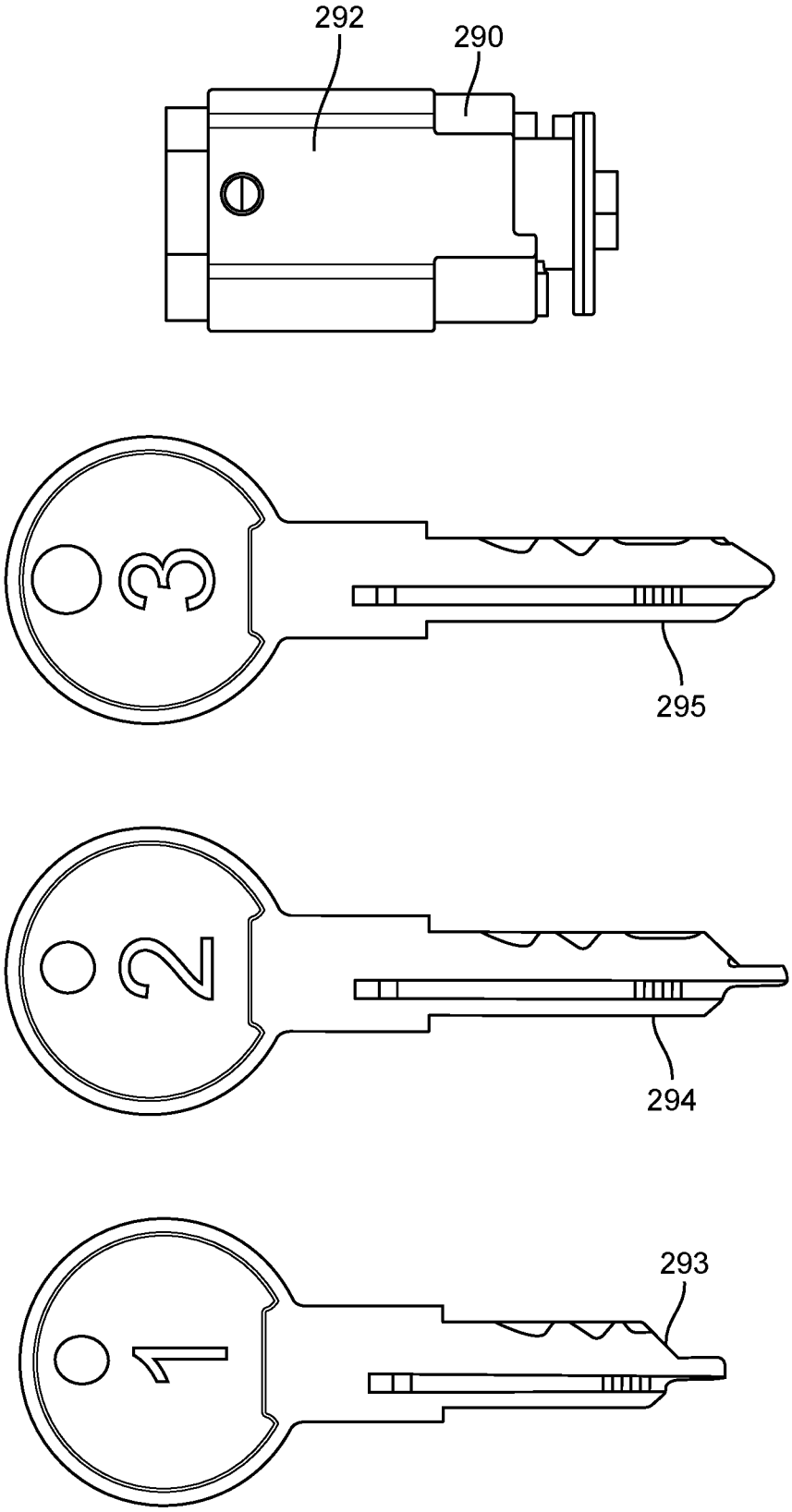
FIG. 5 is a top view of a keyed lock with 3 keys in an embodiment.

FIG. 5 is a top view of a keyed lock 290 with a first key 293, a second key 294, and a third key 295 in an embodiment. The keyed lock 290 provides a lock system that allows a set of multiple keys, here keys 293, 294, and 295, to work with a single cylinder lock to create multiple lock combinations. A reset key 410 shown in FIG. 18 may also be employed. Should a user lose one of the keys, the user can use anyone of the remaining keys to create a new lock combination to operate the lock, yet render the lost key inoperable to operate the same lock. This eliminates the need to replace an entire lock system from a door when a key is lost, yet maintains the maximum security of the lock in the event that an unauthorized person finds the lost key and attempts to use the lost key on the lock.

As discussed above, the combination lock 101 allows a user to recalibrate the combination lock 101 to a new manager key making the compromised key no longer functional. This feature provides a fast and simple solution to a potential security threat without the need to replace the locks. The user uses a new key and makes sure that the lock 101 is in a locked position and the center knob 110 cannot be turned. The user then firmly inserts the new key into the keyhole slot 112. The user then turns the center knob 110 back to the "unlocked" position, and then turns the center knob 110 back to the "locked" position and removes the new key. This operation cancels out the current manager key and the new key becomes the only operational manager key. If the new key becomes compromised, this process may be repeated with another replacement key.

Figure 6:
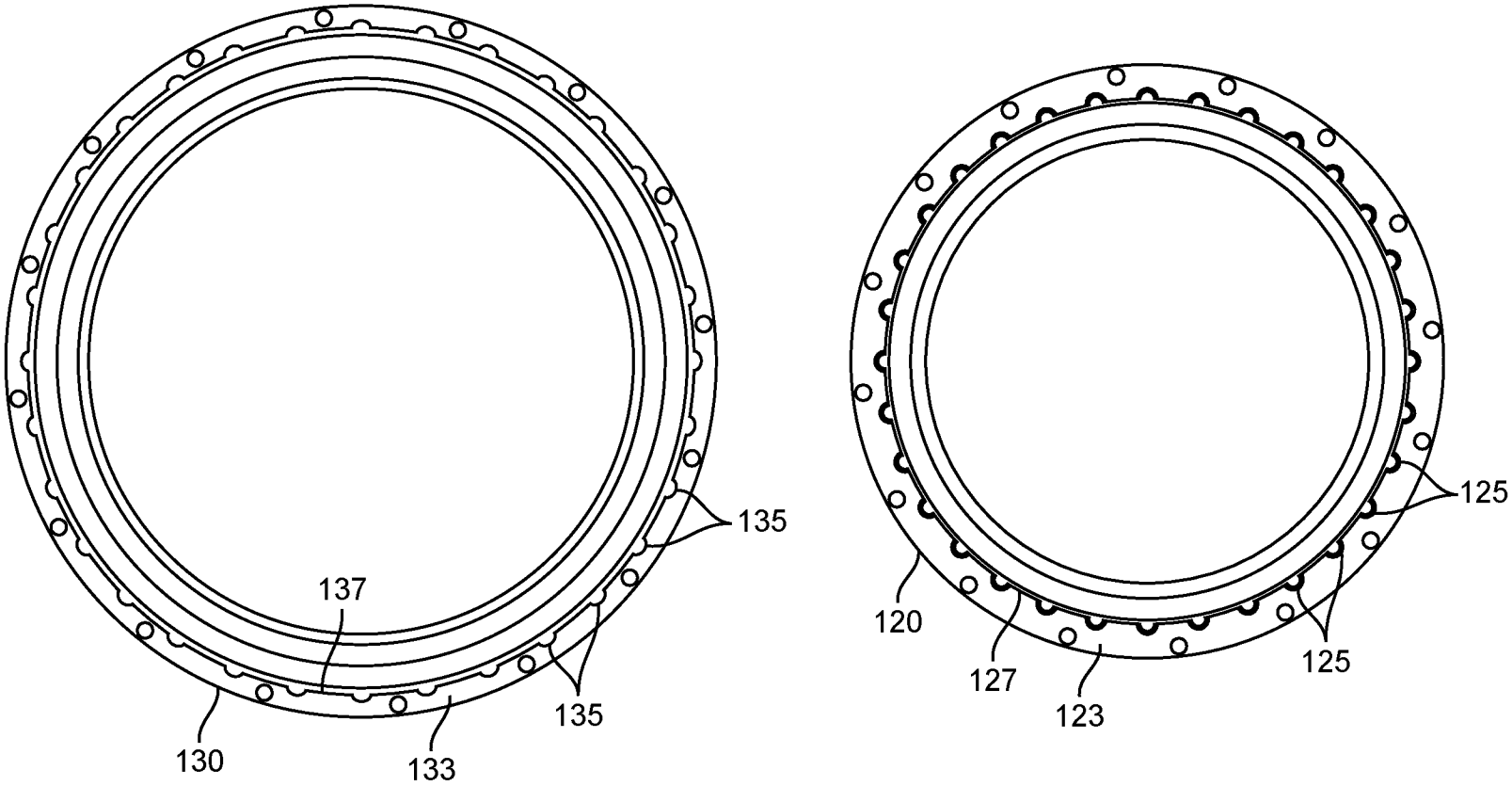
FIG. 6 is a bottom view of the dial wheels.
Figure 9:
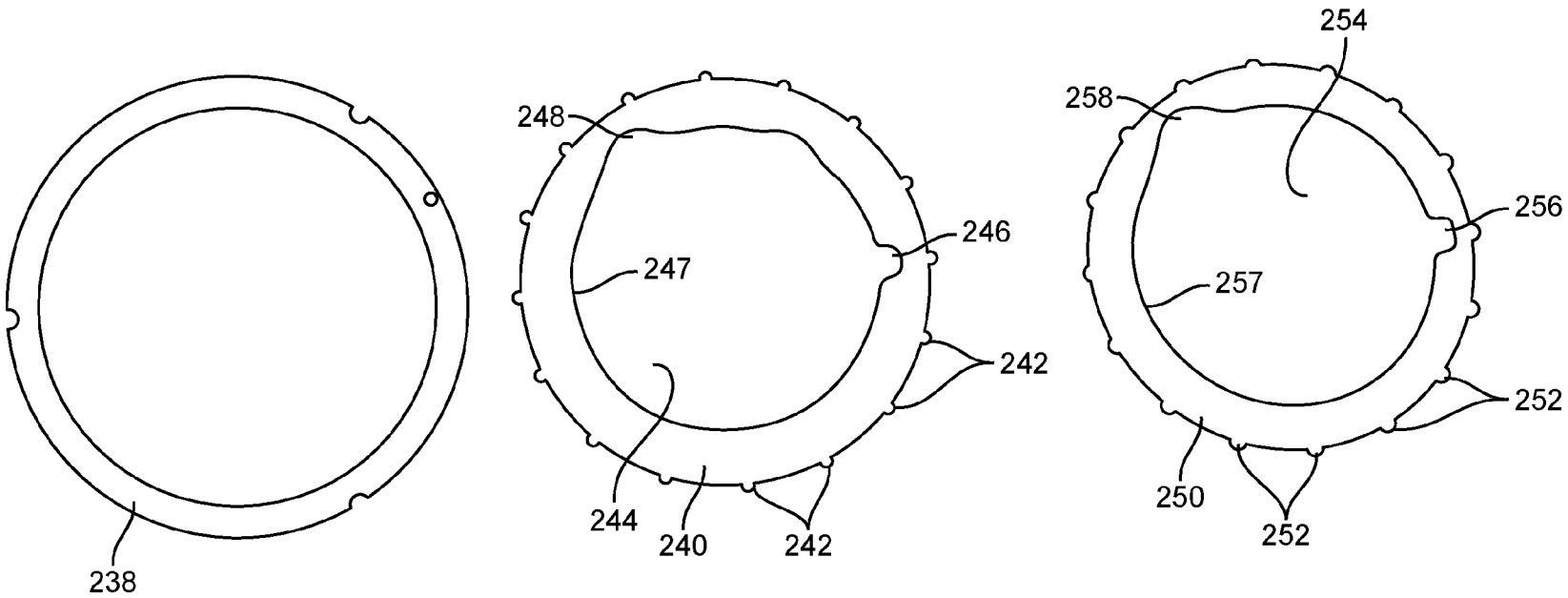
FIG. 9 is a top view of the spring, the first ring, and the second ring.

FIG. 6 is a bottom view of the dial wheels 120 and 130. Outer dial wheel 130 has an interior wall 137 on the vertical portion 133, on which are a series concave indentations 135 configured to receive and release the protrusions 242 of the outer ring 240 as seen in FIG. 9 and discussed below. Likewise, inner dial wheel 120 has an interior wall 127 on the vertical portion 123, on which are a series concave indentations 125 configured to receive and release the protrusions 252 of the inner ring 250.

Figure 7A:
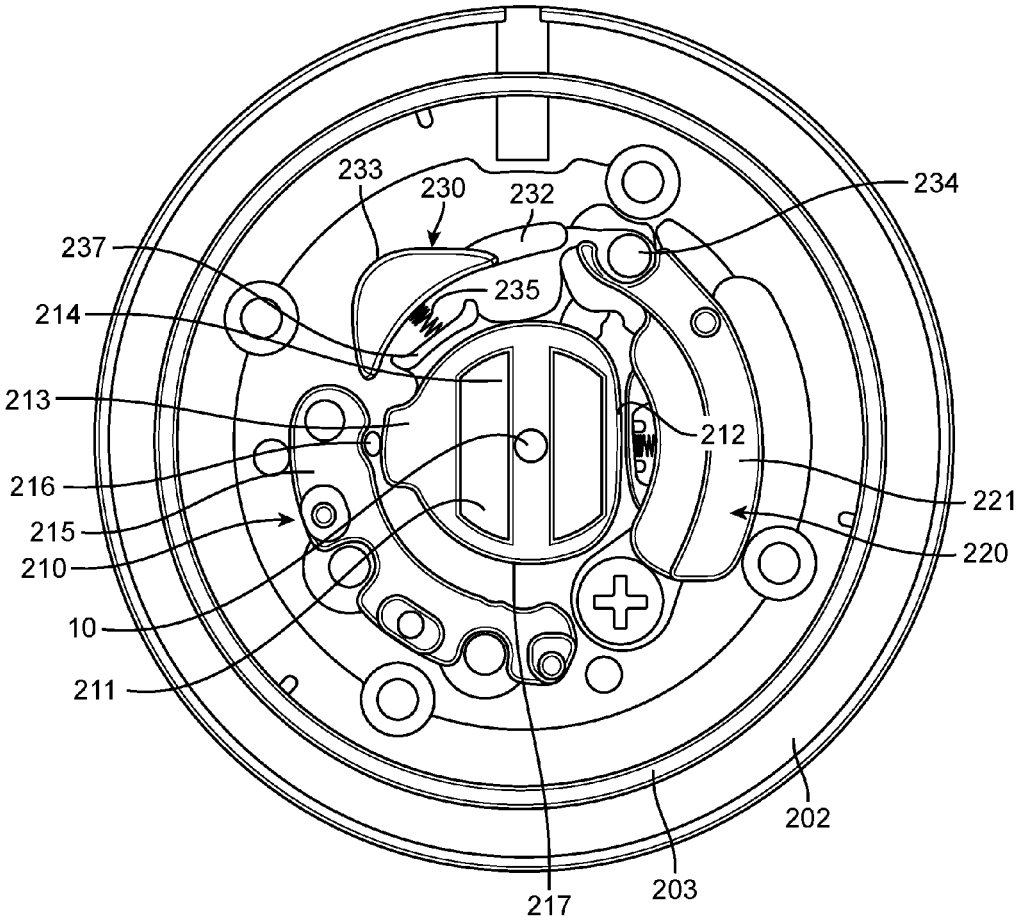
FIG. 7A is a top view of the partially disassembled inner locking mechanism where the lock is locked.

FIG. 7A is a top view of a partially disassembled inner locking mechanism 201 where the lock 101 is locked, and illustrates a locking assembly 210, a tensioning assembly 230, and a ring engagement assembly 220. A locking assembly 210 comprises a generally circular locking disk 211, a raised shoulder 215, and a bearing 216. The generally circular locking disk 211 is centered and movably coupled to the center axis 10 of the base plate 202. The locking disk 211 has a flat edge 212 at the perimeter of the locking disk 211 and a protruding arm 213 emerging way from the center axis 10. The protruding arm 213 is positioned opposite the flat edge 212. The protruding arm 213 is coupled to a groove (not shown) in the raised shoulder 215 via a bearing 216 which restricts the rotation of the locking disk 211 to a quarter-turn and provides lateral support to the locking disk 211 in an embodiment.

A tensioning assembly 230 comprises a curved arm 232 having a curved surface 233 extending radially away from the center 10, a tensioning spring 235, and a vertical wall 237. The curved arm 232 is pivotally connected to the base plate 202 via a pivot 234. The vertical wall 237 extends radially outward from the base plate 202. The tensioning spring 235 is positioned between the curved arm 232 and the vertical wall 237 urging the curved arm 232 to pivot away radially from the center axis 10.

Figure 7B:
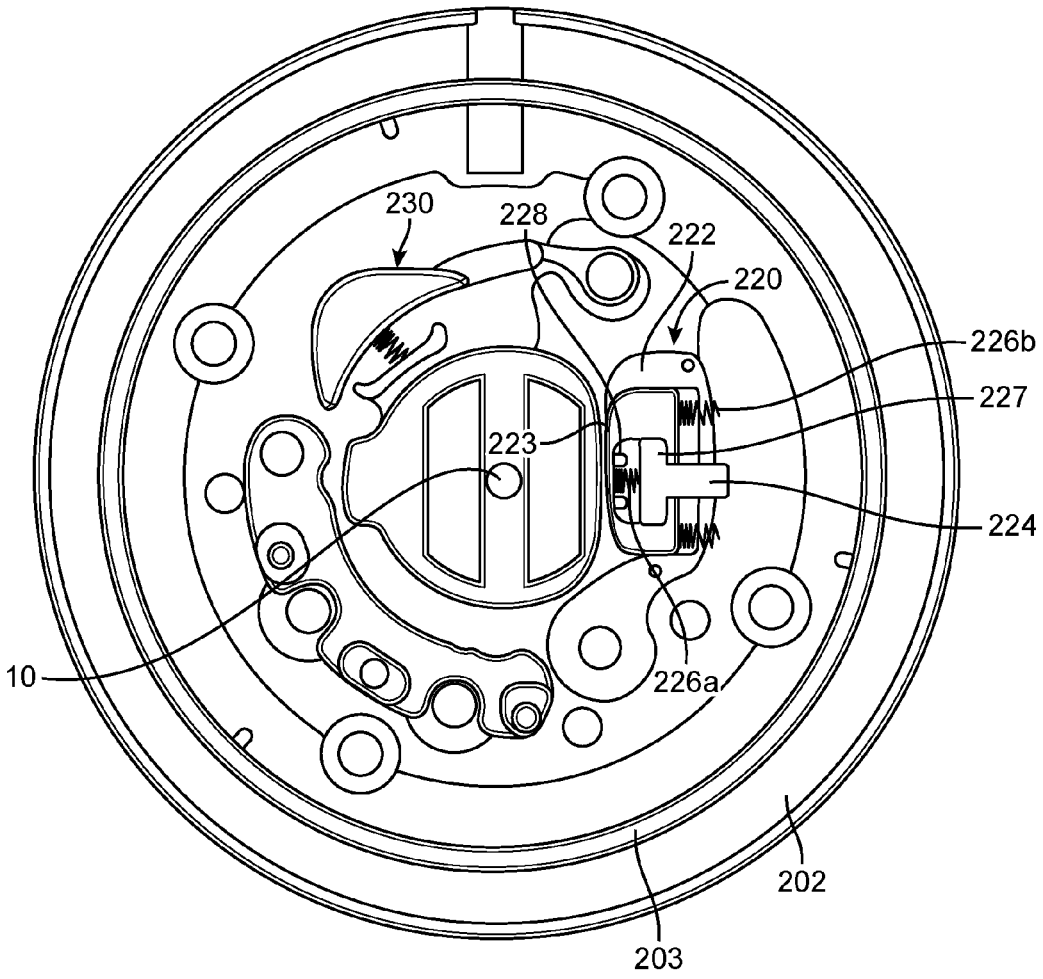
FIG. 7B is a top view of the partially disassembled inner locking mechanism show details of the ring engagement assembly.

A ring engagement assembly 220 is shown in FIG. 7A with a cover 221 in place, and with the cover 221 removed in FIG. 7B.

FIG. 7B is a top view of the partially disassembled inner locking mechanism showing details of the ring engagement assembly 220. The ring engagement assembly 220 comprises cover 221, a ring engagement shell 222, a "T" shaped member 227 having pins 224, and springs 226*a* and 226*b*. The cover 221 has slots on the vertical surface (not shown) which receive the pins 224. The ring engagement shell 222 has an internal cavity 228 configured for releasable confining the T-shaped member 227. The flat surface of the ring engagement shell 222 is in contact with the locking disk 211. When the flat surface of the ring engagement shell 222 is in contact with the flat portion 212 of the locking disk 211, the ring engagement shell 222 emerges inward toward the center axis 10 as a result of the urging of springs 226*a*.

Figure 8:
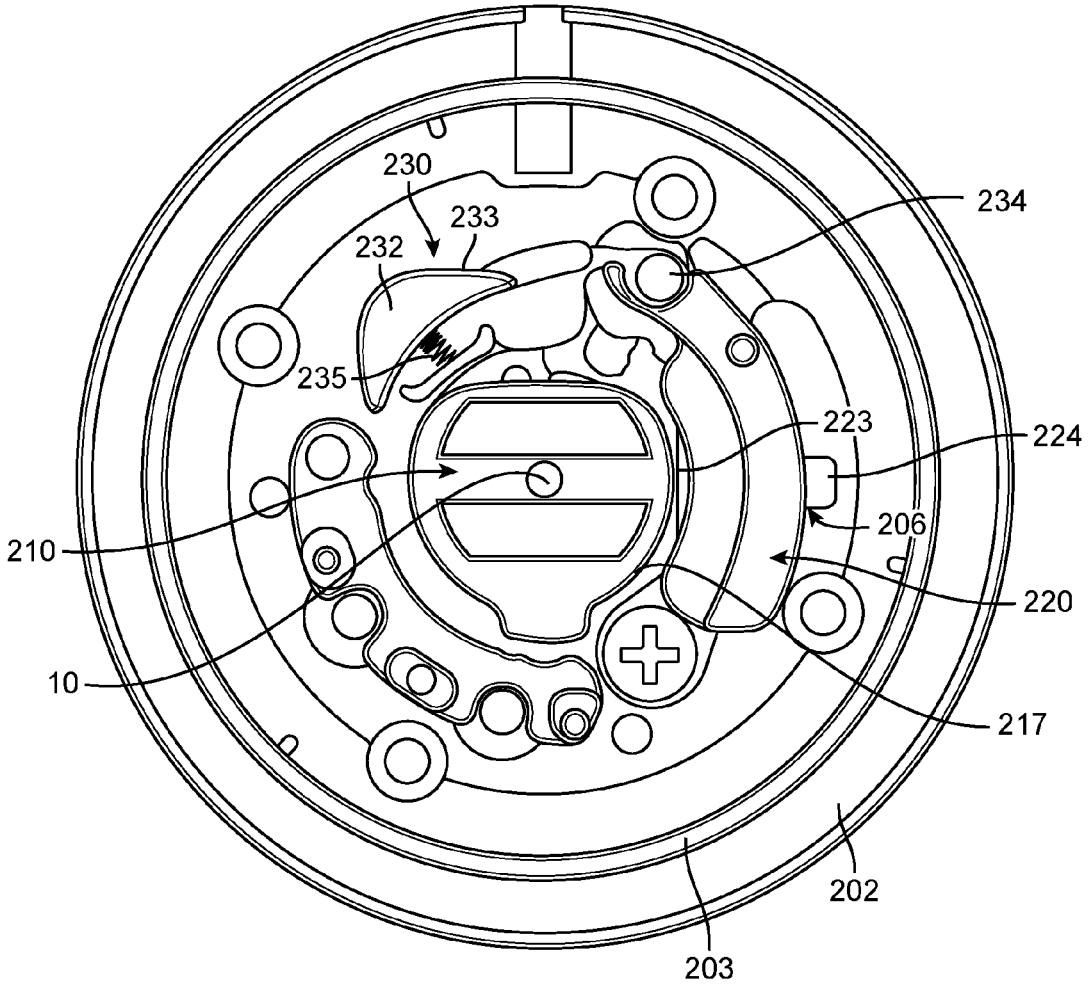
FIG. 8 is a top view of a partially disassembled inner locking mechanism where the lock is unlocked.

FIG. 8 is a top view of the partially disassembled inner locking mechanism where the lock is unlocked. As shown, when the flat surface of the ring engagement shell 222 is in contact with the circular portion of the locking disk 211, the ring engagement shell 222 retreats outward away from the center axis 10 and the pins 224 extend through the slots in the cover 220 as a result of the urging of springs 226*a*.

FIG. 9 is a top view of the spring 238, the outer ring 240, and the inner ring 250. The spring 238 is circular and configured to urge an upward force to the rings. Spring 238 may be a flat wire compression spring or a wave spring in one or more embodiments.

The outer ring 240 is circular and has an aperture 244 forming an interior circumference 247. A notch 246 is formed in the interior circumference 247 as well as a curved interior surface 248. The notch 246 is configured to receive the pins 224 of the ring engagement assembly 220, and the curved interior surface 248 is adapted to conform to the shape of the curved surface 233 of the tensioning assembly. The outer ring 240 has a series of protrusions 242 formed around the outer perimeter which are adapted to be received by outer dial wheel 130.

The inner ring 250 is circular and has an aperture 254 forming an interior circumference 257. A notch 256 is formed in the interior circumference 257 as well as a curved interior surface 258. The notch 256 is configured to receive the pins 224 of the ring engagement assembly 220, and the curved interior surface 258 is adapted to conform to the shape of the curved surface 233 of the tensioning assembly. The inner ring 250 has a series of protrusions 252 formed around the outer perimeter which are adapted to be received by outer dial wheel 120.

Figure 10:
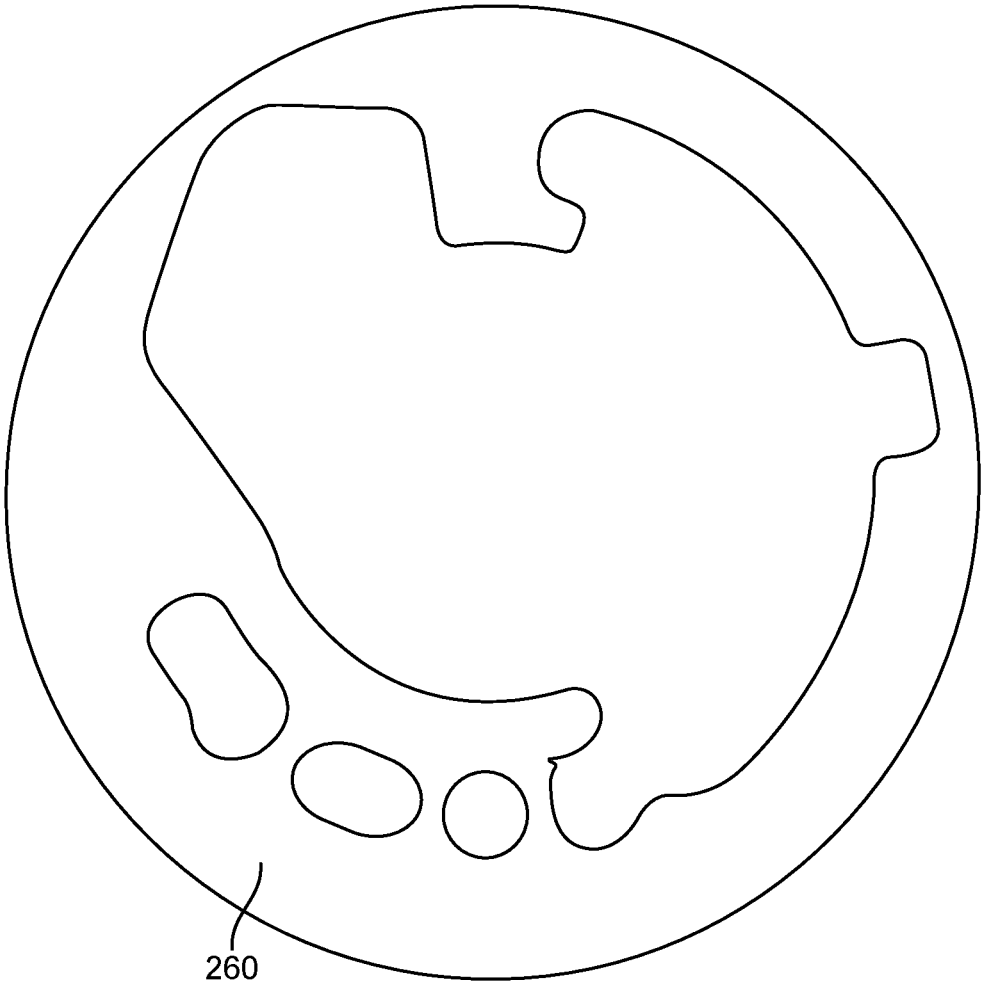
FIG. 10 is a top view of the third ring.

FIG. 10 is a top view of the third ring 260. Third ring 260 is placed immediately above the inner ring 250 and has enough vertical slack is move vertically between the base plate and the top plate compression assembly. Unlike the inner and outer rings 250 and 240, the third ring 260 is not rotatable.

Figure 11:
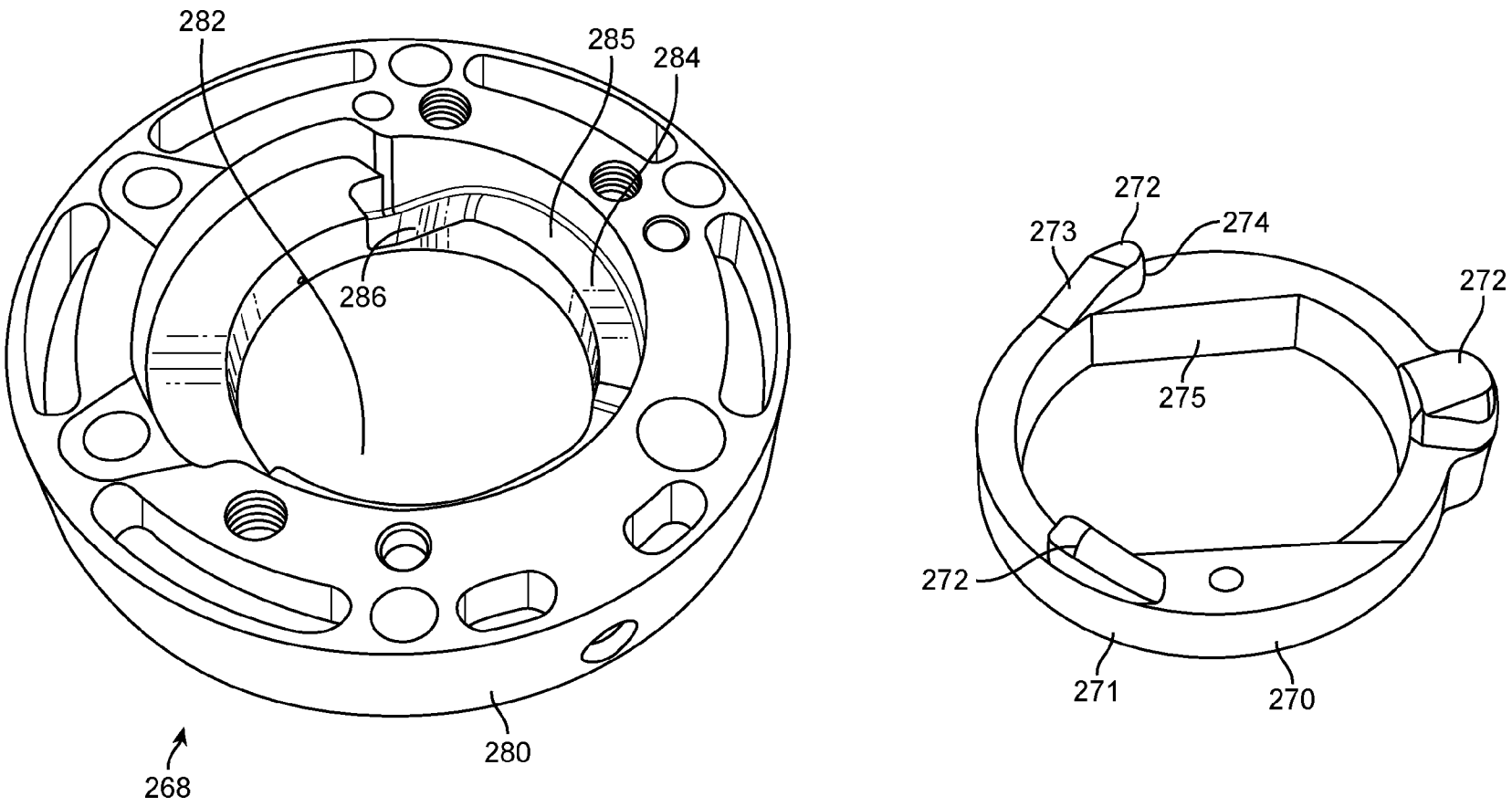
FIG. 11 is a top, perspective view of the top plate compression assembly having a top outer disk and a top inner disk.

FIG. 11 is a top, perspective view of the top plate compression assembly 268 having a top outer ring 280 and a top inner ring 270. The compression assembly 268 is configured for compressing and releasing the inner and outer rings 250 and 240 as well as the third ring 260. The compression assembly 268 serves to position the inner and outer rings 250 and 240 so that they be received or released by the inner and outer dial wheels 120 and 130 respectively.

The compression assembly 268 comprises a two piece disk assembly comprising an outer disk 280 having an aperture 282 and an inner disk 270 sized to be received within the outer disk 280. The inner disk 270 has three teeth 272 protruding away from the inner disk 270. Each of the three teeth 272 has a slopped surface 273 and a nearly vertical surface 274. The outer disk 280 has a channel 284 formed in the inner circumference with the channel flat 285 in three regions and has three indentations 286. The channel 284 is shaped to receive the inner disk 270. The inner disk has two flat surfaces 275 for receiving the flat surfaces 292 or the keyed lock 290.

Figure 12:
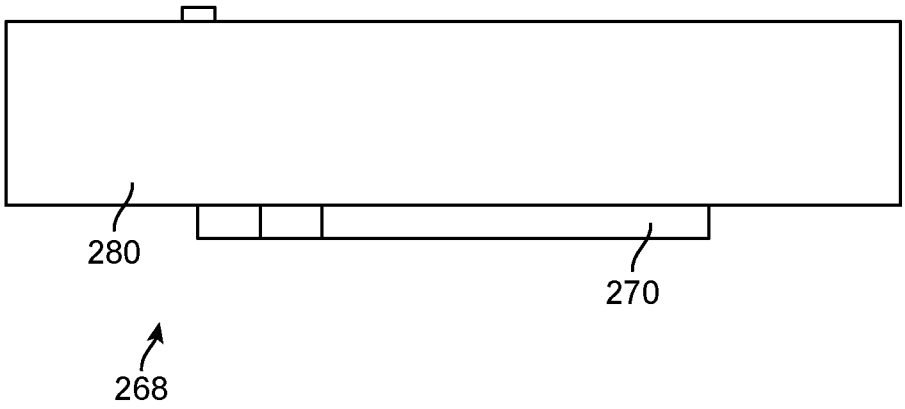
FIG. 12 is a side view of the top plate compression assembly where the inner ring is essentially flush with the outer ring.
Figure 13:
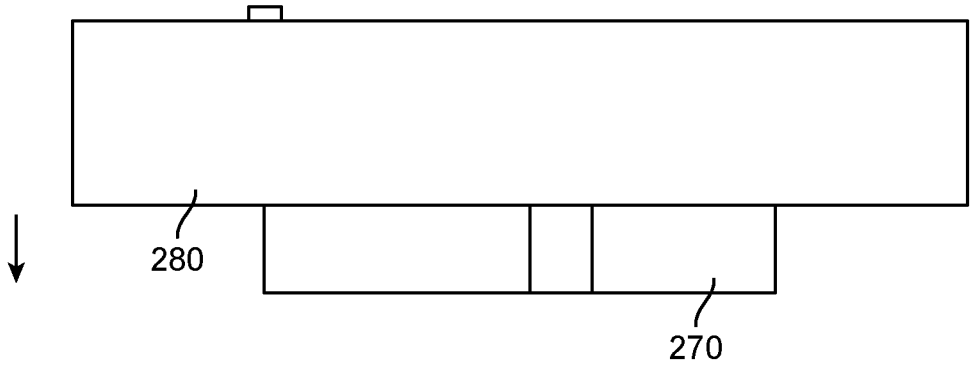
FIG. 13 is a side view of the top plate compression assembly where the inner ring extends outward applying compression to the first, second, and third rings.

FIG. 12 is a side view of the top plate compression assembly where the inner ring 270 is essentially flush with the outer ring 280 when the teeth 272 of the inner disk 270 is seated in the indentation 286 of the outer disk 280. FIG. 13 is a side view of the top plate compression assembly where the inner ring 270 extends outward applying compression to the inner and outer rings 250 and 240 as well as the third ring 260. Here the when the teeth 272 of the inner disk 270 is seated in the flat regions 285 of the channel 284 of the outer disk 280.

Figure 14:
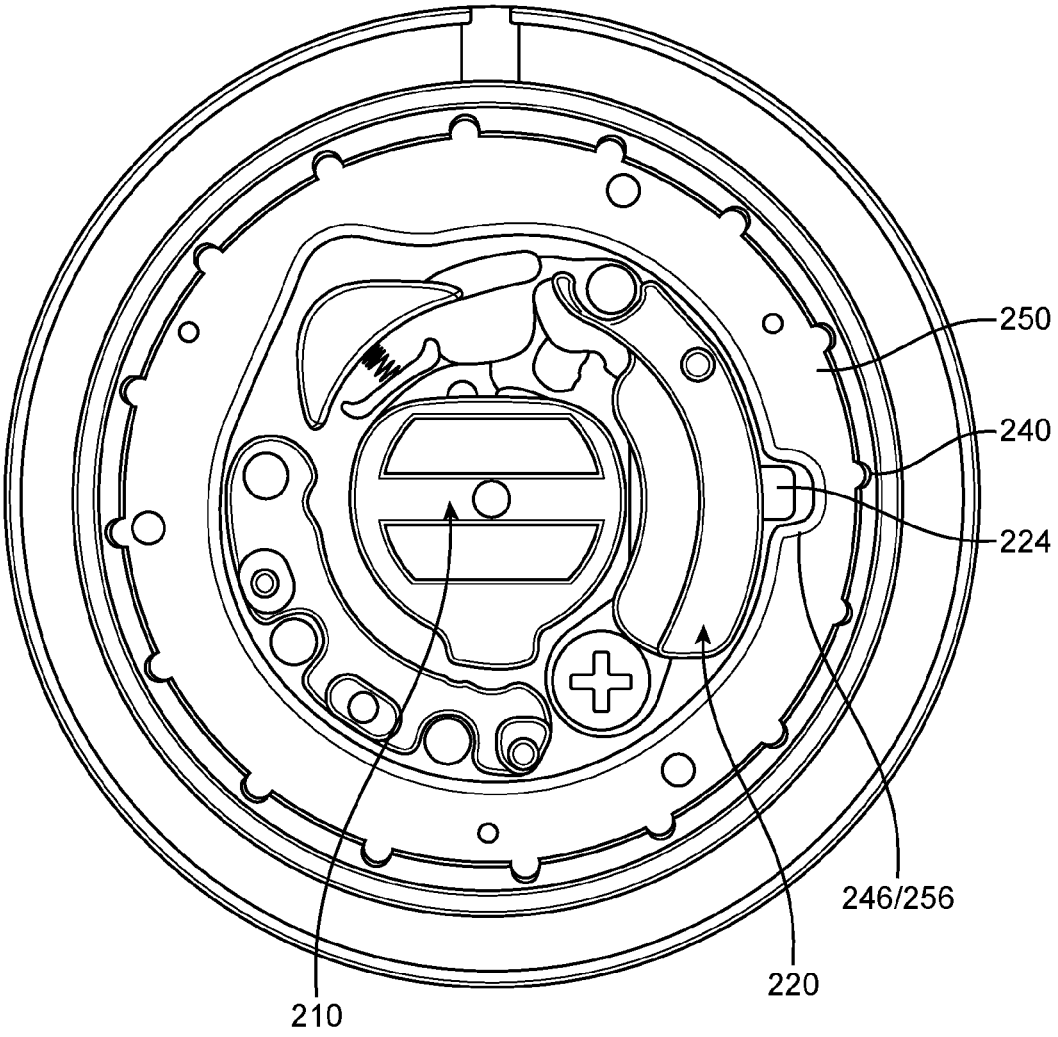
FIG. 14 is a top view of a partially disassembled inner locking mechanism with the first and second rings where the lock is unlocked.

FIG. 14 is a top view of a partially disassembled inner locking mechanism with the first and second rings 240 and 250 where the lock is unlocked. The ring engagement assembly 220 has spring-loaded pins 224 extending radially toward the interior aperture of the inner and outer rings 250 and 240. The ring engagement assembly 220 unlocking the lock 101 when the pins 224 are aligned with the notches 246 and 256 of the inner and outer rings 250 and 240. The ring engagement assembly 220 secures the inner and outer rings 250 and 240 rings when the pins 224 align with the notches 246/256 of the inner and outer rings 250 and 240 rings.

Figure 15:
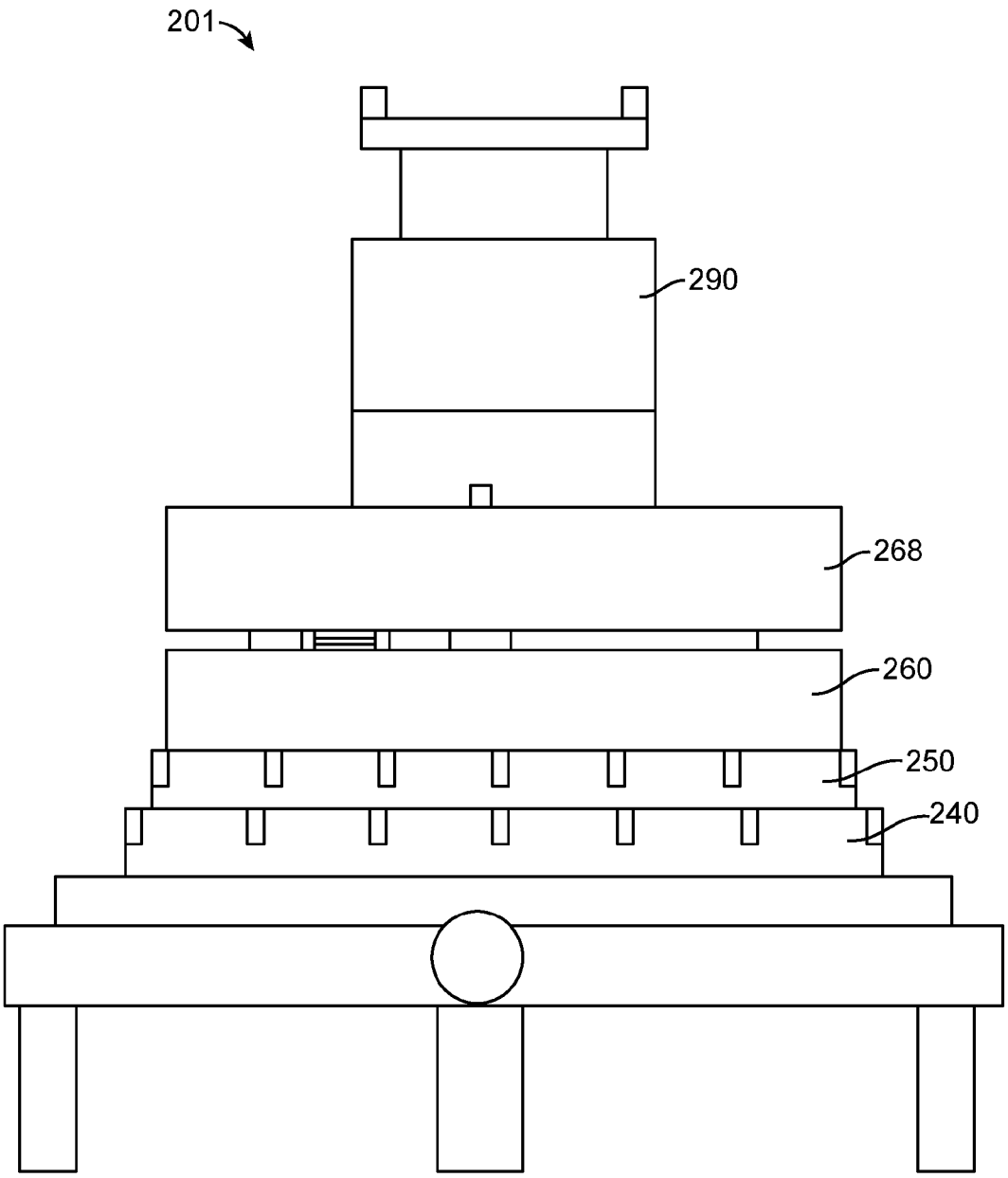
FIG. 15 is a side view of the inner locking mechanism when the lock is locked.
Figure 16:
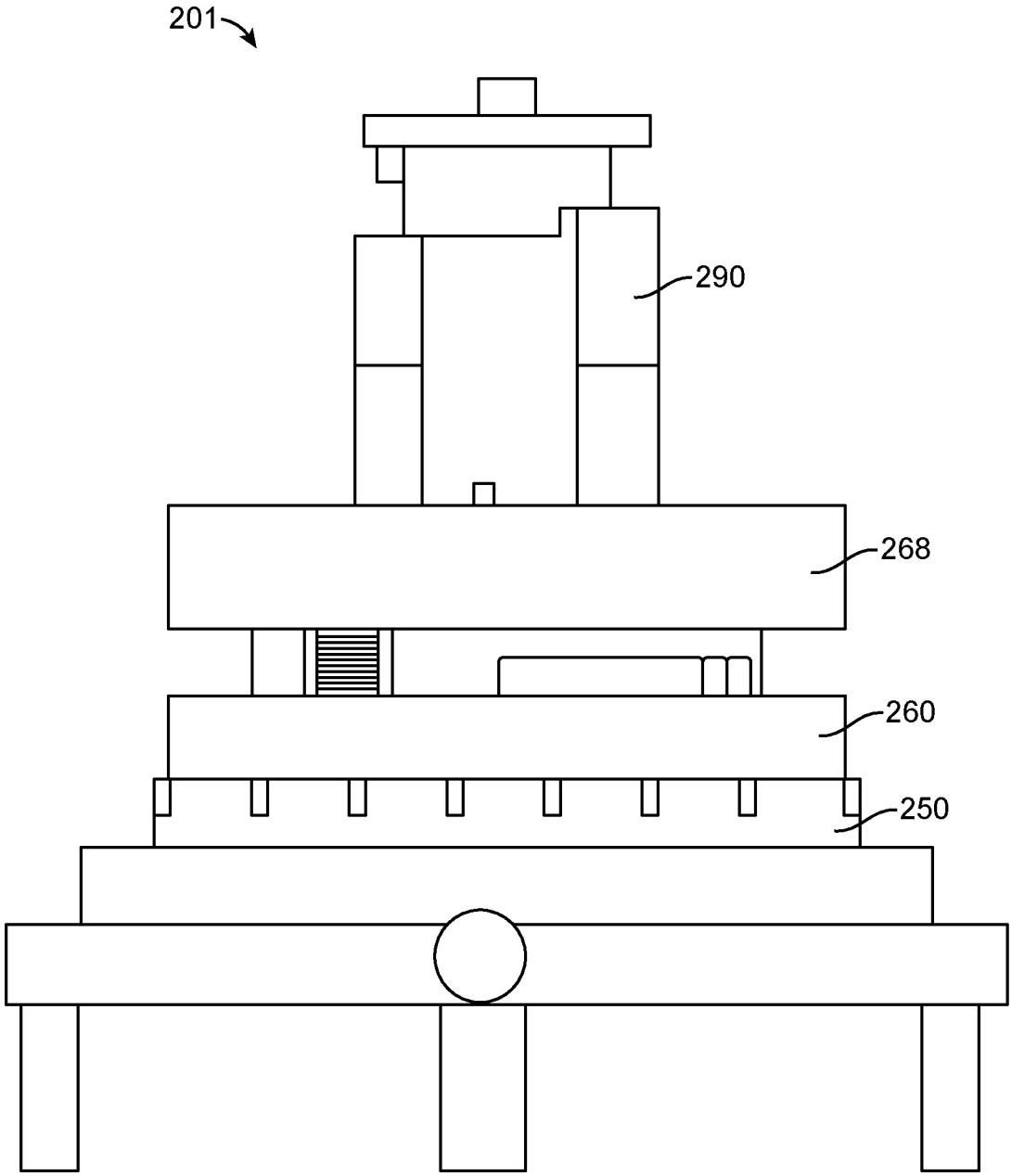
FIG. 16 is a side view of the inner locking mechanism when the lock is unlocked.

FIG. 15 is a side view of the inner locking mechanism 201 when the lock 101 is locked, and FIG. 16 is a side view of the inner locking mechanism when the lock 101 is unlocked. Note that the compression assembly 268 forces the inner and outer rings 250 and 240 to engage and release from the inner and outer dial wheels 120 and 130.

Figure 17:
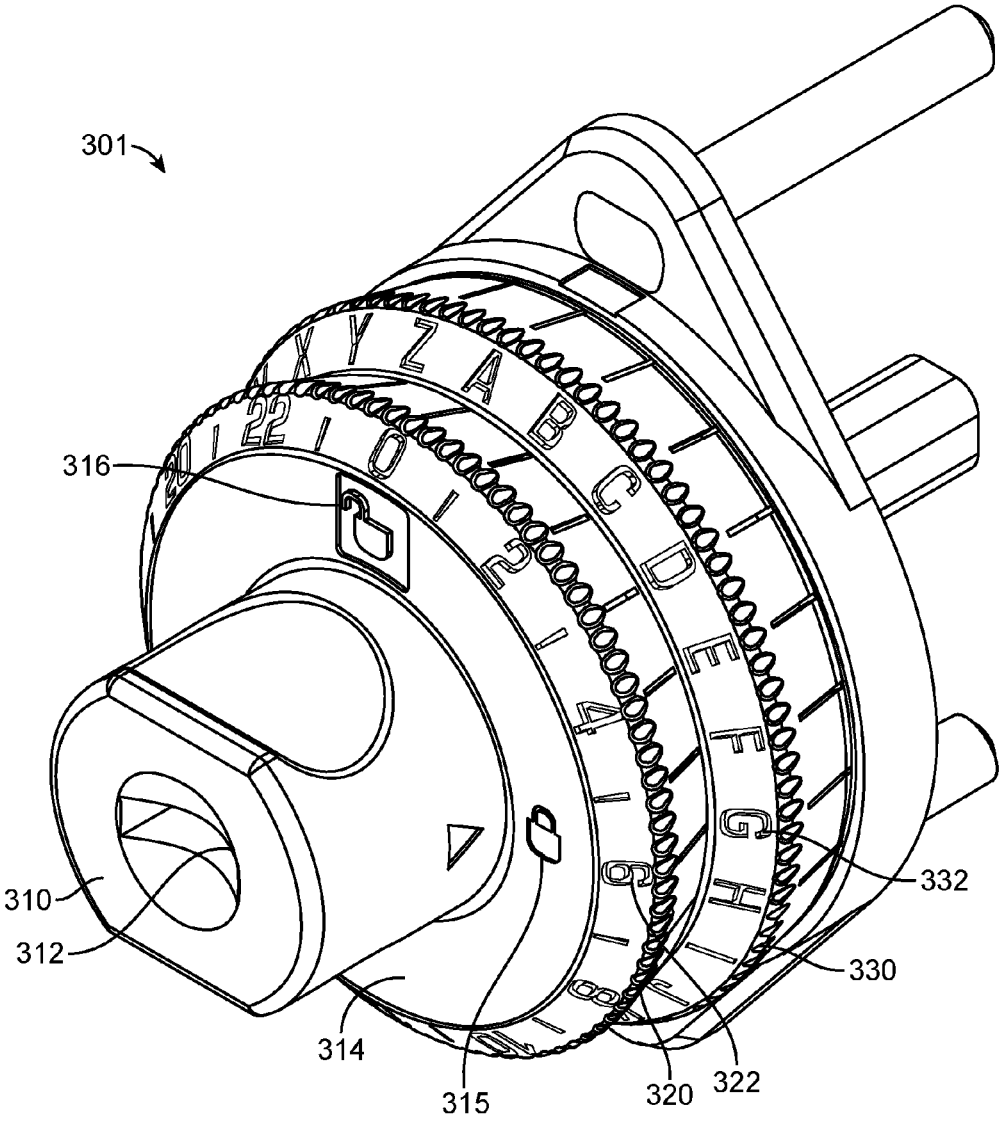
FIG. 17 is a front, perspective view of a reprogrammable combination lock having a keyed lock in one or more embodiments.

FIG. 17 is a front, perspective view of a reprogrammable combination lock 301 having a keyed lock in one or more embodiments. The combination lock 301 comprises a center knob 310, a lock status indicator ring 314, an inner dial wheel 320 (i.e., the second dial wheel), and an outer dial wheel 3130 (i.e., the first dial wheel). The inner dial wheel 320 has indicia of letters and symbols 322. The outer dial wheel 330 has indicia of numbers 332.

Figure 18:
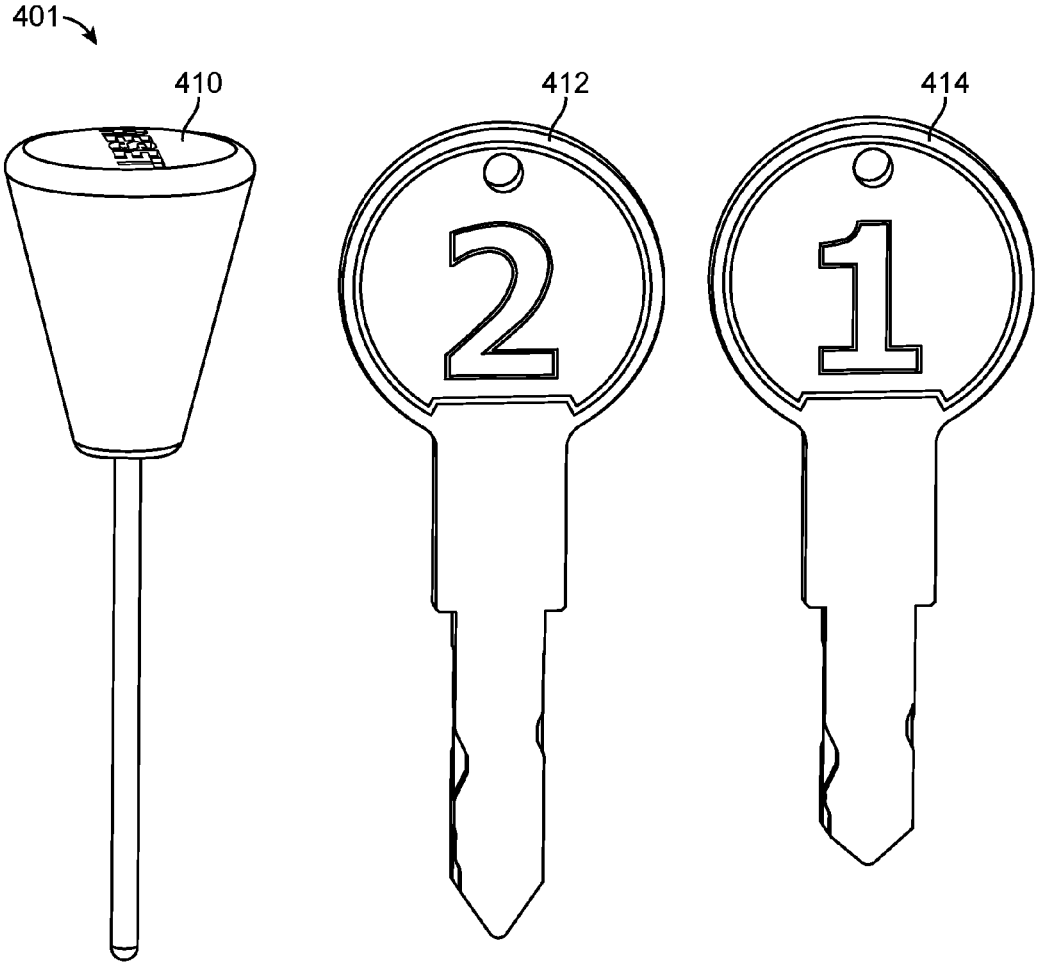
FIG. 18 is a top view of the first, second, and reset keys.

FIG. 18 is a top view of the keyset 401 including a first 414, second 412, and reset key 414. As discussed above, embodiments allow multiple keys to lock and unlock the combination lock 301. In one embodiment of the invention, the cylinder core can be used with at least two different keys 412 and 414. In the event that a user loses the first key 414, the user can use the second key 412 to create a new lock combination to operate the lock, yet render the lost key (the first key 414) inoperable to operate the same lock. This eliminates the need to replace an entire lock system from a door when a key is lost, yet maintains the maximum security of the lock in the event that an unauthorized person finds the lost key and attempts to use the lost key on the lock. The reset key 410 may be used to reset the lock so that the first key 414 is operable.

Figure 19:
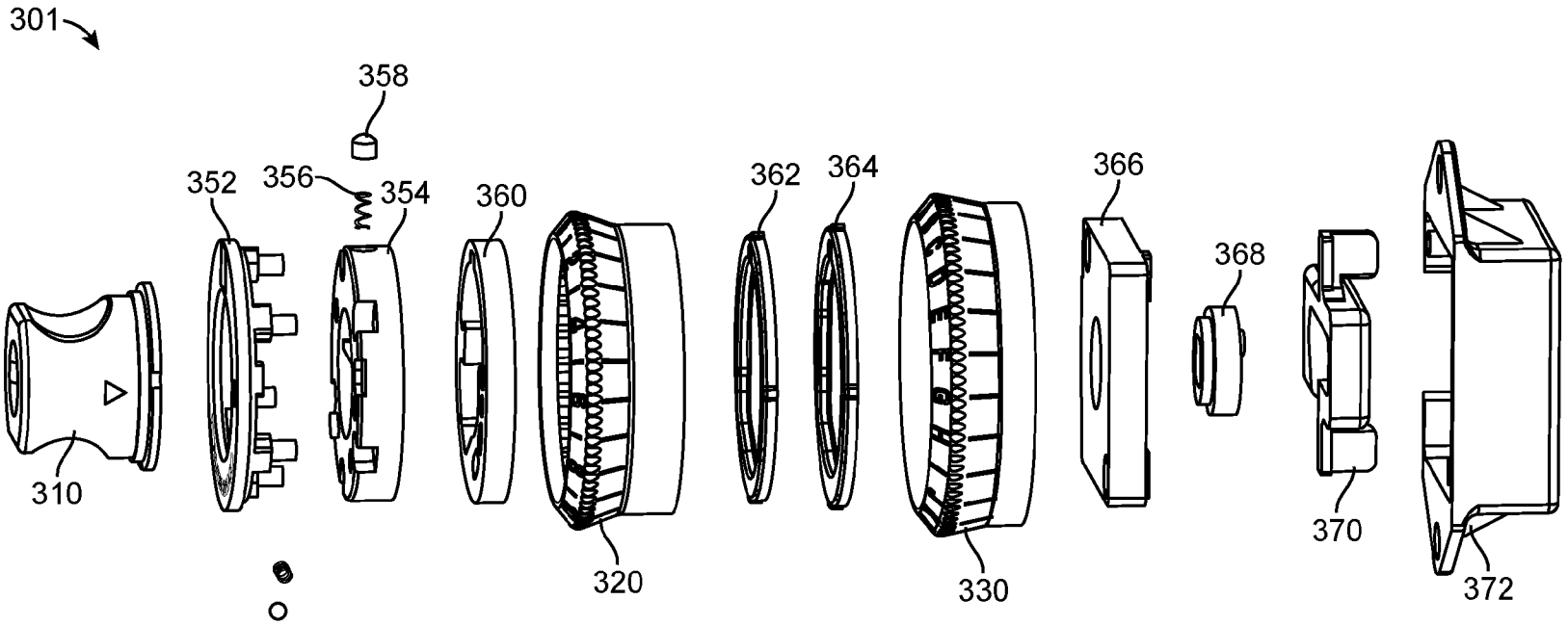
FIG. 19 is an exploded view of the reprogrammable combination lock in an embodiment.

FIG. 19 is an exploded view of the reprogrammable combination lock 301 in an embodiment. The combination lock 301 comprises a center knob 310, a first plate 352, a second plate 354, a spring 356, a ball bearing 358, an inner dial wheel 320, a first ring 362, a second ring 364, an outer dial wheel 330, a third plate, a cylindrical member 368, a fourth member, and a housing 372.

Figure 20:
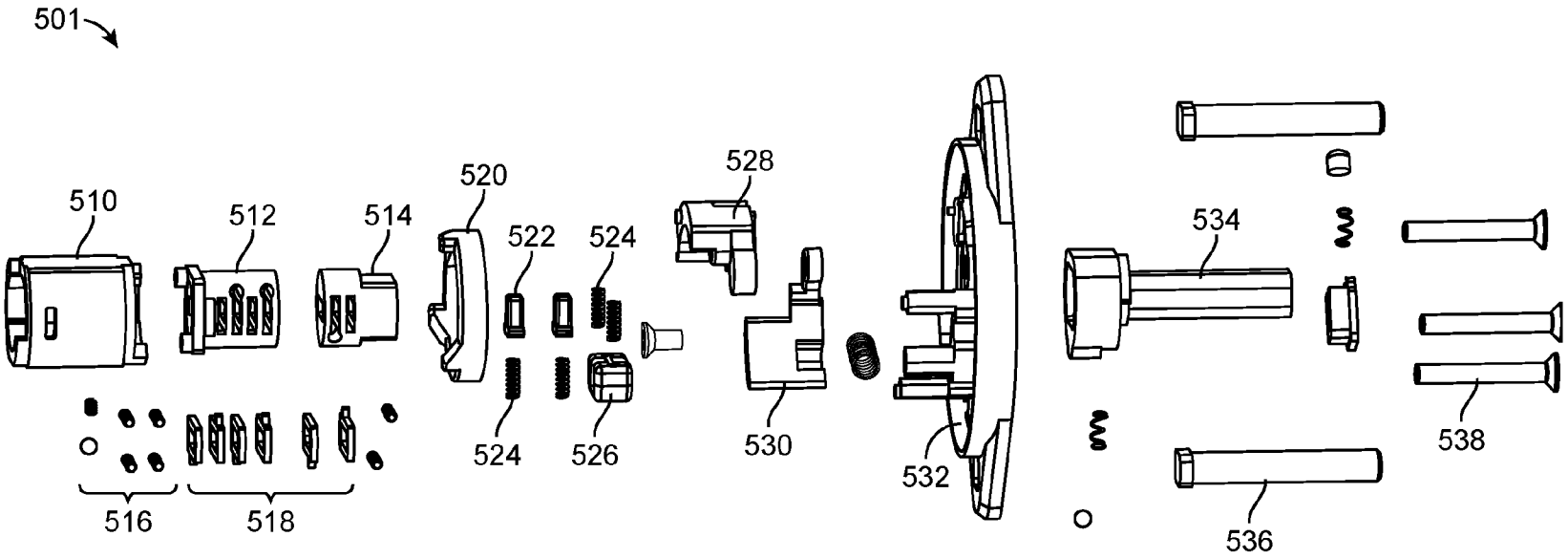
FIG. 20 is an exploded view of the keyed lock in an embodiment.

FIG. 20 is an exploded view of the keyed lock 501 in an embodiment. The keyed lock 501 comprises a cylinder housing 510, a cylinder core 20, a second cylinder core 520, lock springs 516, pin locks 518, a first housing 520, key components 522, 524, and 526, a second key member 528, a third key member 530, a plate 532, a spindle 524, cylinders 536 and 538.

Although the invention has been discussed with reference to specific embodiments, it is apparent and should be understood that the concept can be otherwise embodied to achieve the advantages discussed. The preferred embodiments above have been described primarily as a programmable combination lock. In this regard, the foregoing description of the systems and methods is presented for purposes of illustration and description. It shall be understood that other combinations of computing device are contemplated in one or more embodiments.

Furthermore, the description is not intended to limit the invention to the form disclosed herein. Accordingly, variants and modifications consistent with the following teachings, skill, and knowledge of the relevant art, are within the scope of the present invention. The embodiments described herein are further intended to explain modes known for practicing the invention disclosed herewith and to enable others skilled in the art to utilize the invention in equivalent, or alternative embodiments and with various modifications considered necessary by the particular application(s) or use(s) of the present invention.

What is claimed is:

1. A programmable combination lock assembly comprising:

a base plate;

a spring positioned above the base plate;

a stack of rotatable rings including a first ring and a second ring, each of the first and second rings having a notch formed in the interior circumference and a series of protrusions formed around the outer perimeter, the first ring positioned immediately above the spring, the second ring positioned immediately above the first ring, wherein the spring is urging the stack of rotatable rings away from the base plate;

a stack of dial wheels including a first dial wheel and a second dial wheel, each of the first and second dial wheels having an interior wall having a series of concave indentations configured to receive and release the protrusions of the rotatable rings, the first dial wheel configured to receive the first ring, the second dial wheel configured to receive the second ring;

a compression assembly for compressing and releasing the first and second rings, the compression assembly positioning the first and second rings so that the first and second rings may be received or released by the first and second dial wheels respectively;

an ring engagement assembly having spring-loaded pins extending radially outward from a center axis toward the interior aperture of the rotatable rings, the ring engagement assembly unlocking the lock when the pins are aligned with the notches of the rotatable rings, the ring engagement assembly securing the rings when the pins align with the notches of the rotatable rings;

a locking assembly coupled to the ring engagement assembly, the locking assembly rotatable from a locked position to an unlocked position; and, a keyed lock coupled to the ring engagement assembly configured to selectively unlock the combination lock.

2. The programmable combination lock assembly of claim 1, wherein the compression assembly comprises a two piece disk assembly comprising an outer disk having an aperture and an inner disk sized to be received within the outer disk, the inner disk having three teeth protruding away from the inner disk, each of the three teeth having a slopped surface and a nearly vertical surface, the outer disk having a channel formed in the inner circumference, the channel flat in one region and having three indentations, the channel shaped to receive the inner disk.

3. The programmable combination lock assembly of claim 1, wherein the locking assembly comprises a generally circular locking disk centered and movably coupled to the center axis of the base plate, the locking disk having a flat edge at the perimeter of the locking disk and a protruding arm emerging way from the center axis, the protruding arm positioned opposite the flat edge.

4. The programmable combination lock assembly of claim 1, wherein the keyed lock can override the combination lock in a locked position by receiving a key into the keyed lock, allowing the combination lock to set to an unlocked state, and allowing dialing of the dial wheels until the dial wheels are secured in place.

5. The programmable combination lock assembly of claim 4, wherein the code indicated when all of the dial wheels are secured indicates the last combination code used.

6. The programmable combination lock assembly of claim 1, further comprising a tensioning assembly comprising a curved arm, a tensioning spring, and a vertical wall, the curved arm pivotally connected to the base plate, the vertical wall extending radially outward from the base plate, the tensioning spring positioned between the curved arm and the vertical wall urging the curved arm to pivot away radially from the center axis and engage with the interior of the rotatable rings.

7. The programmable combination lock assembly of claim 1, wherein the keyed lock is reprogrammable having multiple keys such that if a master key is lost, a secondary key can be used to open the combination lock and render the master key inoperable.

8. The programmable combination lock assembly of claim 7, wherein the keyed lock is reprogrammable using a reset key, such that the use of a reset key reactivates the master key.

9. The programmable combination lock assembly of claim 1, wherein the keyed lock is coupled with the inner disk of the compression assembly, the inner disk rotating with the keyed lock and vertically urging the rotatable rings to disengage from the dial wheels.

10. A programmable combination lock assembly comprising:

a base plate;

a spring positioned above the base plate;

a stack of rotatable rings having a notch formed in the interior circumference and a series of protrusions formed around the outer perimeter, the rings positioned above the spring, wherein the spring is urging the stack of rotatable rings away from the base plate;

a stack of dial wheels having an interior wall having a series of concave indentations configured to receive and release the protrusions of the rotatable rings, each dial wheel placed immediately above the associated rotatable ring;

a compression assembly for compressing and releasing the rotatable rings, the compression assembly positioning the rotatable rings so that the rings may be received or released by the dial wheels;

an ring engagement assembly having spring-loaded pins extending radially toward the interior aperture of the rotatable rings, the ring engagement assembly unlocking the lock when the pins are aligned with the notches of the rotatable rings, the ring engagement assembly securing the rings when the pins align with the notches of the rotatable rings;

a locking assembly coupled to the ring engagement assembly, the locking assembly rotatable from a locked position to an unlocked position; and, a keyed lock coupled to the ring engagement assembly configured to selectively unlock the combination lock.

11. The programmable combination lock assembly of claim 10, wherein the compression assembly comprises a two piece disk assembly comprising an outer disk having an aperture and an inner disk sized to be received within the outer disk, the inner disk having three teeth protruding away from the inner disk, each of the three teeth having a slopped surface and a nearly vertical surface, the outer disk having a channel formed in the inner circumference, the channel flat in one region and having three indentations, the channel shaped to receive the inner disk.

12. The programmable combination lock assembly of claim 10, wherein the locking assembly comprises a generally circular locking disk centered and movably coupled to the center axis of the base plate, the locking disk having a flat edge at the perimeter of the locking disk and a protruding arm emerging way from the center axis, the protruding arm positioned opposite the flat edge.

13. The programmable combination lock assembly of claim 10, wherein the keyed lock can override the combination lock in a locked position by receiving a key into the keyed lock, allowing the combination lock to set to an unlocked state, and allowing dialing of the dial wheels until the dial wheels are secured in place.

14. The programmable combination lock assembly of claim 13, wherein the code indicated when all of the dial wheels are secured indicates the last combination code used.

15. The programmable combination lock assembly of claim 10, further comprising a tensioning assembly comprising a curved arm, a tensioning spring, and a vertical wall, the curved arm pivotally connected to the base plate, the vertical wall extending radially outward from the base plate, the tensioning spring positioned between the curved arm and the vertical wall urging the curved arm to pivot away radially from the center axis and engage with the interior of the rotatable rings.

16. The programmable combination lock assembly of claim 10, wherein the keyed lock is reprogrammable having multiple keys such that if a master key is lost, a secondary key can be used to open the combination lock and render the master key inoperable.

17. The programmable combination lock assembly of claim 16, wherein the keyed lock is reprogrammable using a reset key, such that the use of a reset key reactivates the master key.

18. The programmable combination lock assembly of claim 10, wherein the keyed lock is coupled with the inner disk of the compression assembly, the inner disk rotating with the keyed lock and vertically urging the rotatable rings to disengage from the dial wheels.

19. A programmable combination lock assembly comprising:

a base plate having a circular well formed by a raised shoulder near the perimeter of the base plate, the center of the circular well defining a center axis which extends away from the base plate perpendicular;

a spring positioned within the well of the base plate, the spring formed as a flat wire compression spring;

a stack of rotatable rings including a first ring and a second ring, each of the first and second rings having a notch formed in the interior circumference and a series of protrusions formed around the outer perimeter, the first ring positioned immediately above the spring, the second ring positioned immediately above the first ring, wherein the spring is urging the stack of rotatable rings away from the base plate;

a stack of dial wheels including a first dial wheel and a second dial wheel, each of the first and second dial wheels having an interior wall having a series of concave indentations configured to receive and release the protrusions of the rotatable rings, the first dial wheel configured to receive the first ring, the second dial wheel configured to receive the second ring;

a compression assembly for compressing and releasing the first and second rings, the compression assembly positioning the first and second rings so that the first and second rings may be received or released by the first and second dial wheels respectively, the compression assembly comprises a two piece disk assembly comprising an outer disk having an aperture and an inner disk sized to be received within the outer disk, the inner disk having three teeth protruding away from the inner disk, each of the three teeth having a slopped surface and a nearly vertical surface, the outer disk having a channel formed in the inner circumference, the channel flat in one region and having three indentations, the channel shaped to receive the inner disk;

an ring engagement assembly having spring-loaded pins extending radially outward from a center axis toward the interior aperture of the rotatable rings, the ring engagement assembly unlocking the lock when the pins are aligned with the notches of the rotatable rings, the ring engagement assembly securing the rings when the pins align with the notches of the rotatable rings;

a locking assembly coupled to the ring engagement assembly, the locking assembly rotatable from a locked position to an unlocked position; and, a keyed lock coupled to the ring engagement assembly configured to selectively unlock the combination lock.

20. The programmable combination lock assembly of claim 19, wherein the keyed lock can override the combination lock in a locked position by receiving a key into the keyed lock, turning the combination lock to an unlocked state, and dialing the first and second dial wheels until the first and second dial wheels are secured in place.

* * * * *